US011197360B1

(12) United States Patent
Leizerovich et al.

(10) Patent No.: US 11,197,360 B1
(45) Date of Patent: Dec. 7, 2021

(54) HIGH-POWER DALI

(71) Applicant: Ubicquia LLC, Fort Lauderdale, FL (US)

(72) Inventors: Gustavo Dario Leizerovich, Fort Lauderdale, FL (US); Ivan Quiroz, Fort Lauderdale, FL (US)

(73) Assignee: Ubicquia, Inc., Fort Lauderdale, FL (US)

( * ) Notice: Subject to any disclaimer, the term of this patent is extended or adjusted under 35 U.S.C. 154(b) by 0 days.

(21) Appl. No.: 17/170,727

(22) Filed: Feb. 8, 2021

Related U.S. Application Data

(62) Division of application No. 17/102,352, filed on Nov. 23, 2020, now Pat. No. 11,019,708.

(51) Int. Cl.

| | |
|---|---|
| ***H05B 47/16*** | (2020.01) |
| ***H05B 47/18*** | (2020.01) |
| ***H05B 47/17*** | (2020.01) |
| ***H05B 47/14*** | (2020.01) |

(52) U.S. Cl.
CPC ..... *H05B 47/18* (2020.01); *H05B 47/14* (2020.01); *H05B 47/16* (2020.01); *H05B 47/17* (2020.01)

(58) Field of Classification Search
None
See application file for complete search history.

(56) References Cited

U.S. PATENT DOCUMENTS

| | | | | |
|---|---|---|---|---|
| 6,762,570 | B1 * | 7/2004 | Fosler | H05B 47/18 315/312 |
| 2015/0091383 | A1 * | 4/2015 | Schmucki | H02J 9/061 307/66 |
| 2017/0273158 | A1 * | 9/2017 | Csibi | H05B 47/165 |

FOREIGN PATENT DOCUMENTS

WO 2019/136480 A2 7/2019

OTHER PUBLICATIONS

Aaron et al., "Light Pole Wireless Networking Device," U.S. Appl. No. 62/614,918, filed Jan. 8, 2018, 76 pages.

* cited by examiner

*Primary Examiner* — Dedei K Hammond
(74) *Attorney, Agent, or Firm* — Daniel C. Crilly; Thomas J. Satagaj

(57) ABSTRACT

A digital addressable lighting interface (DALI) controlled device is arranged to communicate information according to a DALI protocol and powered by electrically coupling the controlled device to a DALI bus. The DALI bus is monitored for initiation of a DALI communication sequence. During a period of non-communication on the DALI bus, a high-current power supply is electrically coupled to the controlled device via the DALI bus. The high-current power supply provides a first high-current power signal to the controlled device. Upon detection of any DALI communication sequence on the DALI bus, the high-current power supply is electrically de-coupled from the controlled device for a determined time period. During the determined time period, a storage element is electrically coupled to the controlled device. The storage element provides a second high-current power signal to the controlled device.

20 Claims, 11 Drawing Sheets

HIGH-POWER DALI

BACKGROUND

Technical Field

The present disclosure generally relates to devices arranged to communicate via a digital addressable lighting interface (DALI). More particularly, but not exclusively, the present disclosure relates to DALI devices that operates using more current than a DALI-compliant master device can provide.

Description of the Related Art

As an acronym for Digital Addressable Lighting Interface, "DALI" is a trademark owned by the IEEE Industry Standards and Technology Organization. In practice, one of skill in the art recognizes DALI, DALI, and D4I as representing one or more open, standardized protocols for luminaires, network controllers, input devices, bus power supplies, control gear, and other lighting industry devices. The DALI standardized protocols are published in multiple parts by, and DALI devices are certified by, the Digital Illumination Interface Alliance (DiiA). An international DALI standard is published in multiple parts by the International Electrotechnical Commission as IEC 62386.

DALI implements a dedicated protocol for a digital lighting control network that enables robust, scalable interoperability of lighting industry components from many manufacturers. A DALI network includes a single DALI network bus power supply, one or more application controllers, control and data input devices (e.g., programmed microcontrollers, industrial Internet of Things (IIoT) devices, sensors, keys, and the like), lighting control devices (e.g., electrical ballasts, LED drivers, dimmers, and other "control gear"), and a communication medium between the devices. Application controllers are arranged to configure, interrogate, and control, slave (i.e., control gear or controlled) devices via bidirectional communication across a DALI interface by including a device identifier, or a plurality of device identifiers, in messages communicated across the network.

A DALI compatible network (i.e., a DALI network) is implemented via a two-wire interface. Power and data are carried by the same pair of wires. The polarity of the wires does not have to be observed. In a DALI network, each controlled device, and each controlling device, is assigned a unique short address in the base-10 numeric range 0 to 63. Hence, a DALI network can support up to 128 devices, wherein 64 of the devices may be DALI control devices, and 64 may be controlled devices (i.e., "control gear"). Individual addresses can be assigned to devices over the DALI network bus via a "commissioning" protocol, and information is communicated across the DALI network via an asynchronous, half-duplex, serial protocol operated at a fixed data transfer rate of 1200 bits per second (1200 bps). The low fixed bit rate of a DALI network allows a DALI network to be implemented in bus or star topologies and without a need for termination resistors.

The DALI network bus is a nominal 16-volt direct current (16 VDC) bus that communicates via Manchester coded data. At idle, the bus sits at 16 VDC. Communication begins with a start bit (i.e., a binary "1" asserted on the bus) followed by eight to thirty-two (8 to 32) data bits in most significant bit first (MSB-first) order. At a fixed data rate of 1200 bps, each data bit will be communicated over a period of about 833 microseconds (833 μsec).

According to Manchester coding, communicating a binary one ("1") data bit requires maintaining the bus high (i.e., "HI") for a first half of a data bit period (i.e., about 416 μsec) and pulling the bus low (i.e., "LO") for a second half of the data bit period. Communicating a binary zero ("0") data bit is opposite—that is, the bus is pulled LO for a first 416 μsec and maintained HI for a second 416 μsec. To begin a data transmission, a binary "1" is asserted on the DALI network bus, and after each communication, the devices must allow at least 2.45 milliseconds (2.45 msec) of idle time on the bus.

Driving the DALI network bus HI requires maintaining 16 VDC on the bus plus or minus six and one-half volts (i.e., 16 VDC+/−6.5 VDC), and bringing the bus LO requires pulling the bus to 0 VDC+/−4.5 VDC.

The DALI bus cabling can be run up to three hundred meters (300 m), and the DALI specification allows for up to a two volt (2V) drop in the communication signal. No termination is required on the DALI bus, and tree, branch, peer-to-peer, and daisy-chain wiring topologies are acceptable, however rings and closed loops are not.

Every DALI bus requires a DALI power supply, which is used at least to operate the communications protocol, and in some cases, also used to power the controlled device. As per the DALI specification, the DALI power supply is a current limited device that must ensure line current on a DALI network bus does not exceed two hundred fifty milliamps (250 mA). A DALI power supply can be wired at any position along the bus. The DALI power supply provides continuous output between 9.5 and 22.5 volts (i.e., 16 VDC+/−6.5 VDC) on the control wires of the DALI bus during periods of non-communication.

All of the subject matter discussed in the Background section is not necessarily prior art and should not be assumed to be prior art merely as a result of its discussion in the Background section. Along these lines, any recognition of problems in the prior art discussed in the Background section or associated with such subject matter should not be treated as prior art unless expressly stated to be prior art. Instead, the discussion of any subject matter in the Background section should be treated as part of the inventor's approach to the particular problem, which, in and of itself, may also be inventive.

BRIEF SUMMARY

The following is a summary of the present disclosure to provide an introductory understanding of some features and context. This summary is not intended to identify key or critical elements of the present disclosure or to delineate the scope of the disclosure. This summary presents certain concepts of the present disclosure in a simplified form as a prelude to the more detailed description that is later presented.

The present inventors have recognized that in some cases, DALI-based control gear (i.e., a controlled device) desires to operate using more than the specification-limited two hundred fifty milliamps (250 mA). In these cases, the inventors have developed novel circuitry that allows such devices to draw more than 250 mA from an otherwise compliant DALI bus. The device, method, and system embodiments described in this disclosure (i.e., the teachings of this disclosure) enable the DALI-based control gear (i.e., a controlled device) to draw more than 250 mA during periods of non-communication on the DALI bus via circuitry that electrically couples a high-current power supply to the DALI bus when DALI communications are not detected and electrically de-couples the high-current power supply from the DALI bus when DALI communications are detected.

In a first embodiment, a method to power a digital addressable lighting interface (DALI) controlled device includes: electrically coupling the controlled device to a DALI bus, the controlled device arranged to communicate information according to a DALI protocol; monitoring the DALI bus for initiation of a DALI communication sequence; during a period of non-communication on the DALI bus, electrically coupling a high-current power supply to the controlled device via the DALI bus, the high-current power supply arranged to provide a first high-current power signal to the controlled device; upon detection of any DALI communication sequence on the DALI bus, electrically de-coupling the high-current power supply from the controlled device for a determined time period; and during the determined time period, electrically coupling a storage element to the controlled device, the storage element arranged to provide a second high-current power signal to the controlled device.

In some cases of the first embodiment, the determined time period is at least five (5) seconds. In these and other cases, the determined time period is less than thirty (30) seconds. In still other cases, the determined time period is based on a detection of non-communication on the DALI bus. Sometimes, the controlled device is an environmental sensor. And sometimes, the high-current signal is a signal that exceeds two hundred fifty milliamps (250 mA) or even exceeds five hundred milliamps (500 mA). In some embodiments, an input source voltage on the DALI bus has a first voltage, and an output source voltage of the high-current signal has a second voltage, the second voltage being less than the first voltage. In some cases of the first embodiment, method further includes charging the storage element via a low-current signal present on the DALI bus during the period of non-communication on the DALI bus. Also in some cases, the low-current signal present on the DALI bus during the period of non-communication on the DALI bus is a signal that does not exceed two hundred fifty milliamps (250 mA).

In a second embodiment, a system includes: a smart lighting device having a digital addressable lighting interface (DALI) controller; and a controlled device electrically coupled to the smart lighting device via a DALI bus, wherein the controlled device is arranged to receive a first high-current signal from a DC-DC power supply that is electrically coupled to the DALI bus during a non-communication period on the DALI bus, and wherein the controlled device is arranged to receive a second high-current signal from a storage element that is electrically de-coupled from the DALI bus during a communication period on the DALI bus.

In some cases of the second embodiment, the controlled device is an environmental sensor device. Sometimes, the first- and second-high current signals exceed, at least some of the time, two hundred fifty milliamps (250 mA). The smart lighting device is electromechanically coupled to a streetlight in some cases, and the controlled device is further arranged to charge the storage element via current drawn from the DALI bus during the non-communication period in these and other cases.

In a third embodiment, a circuit includes: a voltage/communication signal input; a voltage signal output; a switch having a switch input, a switch output, and a switch selector, the switch input electrically coupled to the voltage/communication signal input; and a trigger circuit having a trigger input and a trigger output, the trigger input electrically coupled to the voltage/communication signal input and the trigger output electrically coupled to the switch selector, wherein the trigger circuit is arranged to: detect a state change on the voltage/communication signal input; and based on a detected state change, the trigger circuit further arranged to: institute a timing sequence having a certain time duration; and assert a switch disabling signal that causes the switch selector to disable the switch during the certain time duration. The circuit also includes a power supply having a power supply input and a power supply output, the power supply output electrically coupled to the voltage signal output; a current limiting circuit electrically coupled between the switch output and the power supply input; and a storage element circuit electrically coupled to the power supply output and the voltage signal output, the storage element configured to receive a charging voltage from the power supply at a first time, and further configured to provide a supply voltage to the voltage signal output during a second time.

In some cases of the third embodiment, the timing sequence is at least twenty (20) seconds, and in these and other cases, the timing sequence is less than thirty (30) seconds. Sometimes, the voltage/communication signal input is configured as a digital addressable lighting interface (DALI) signal input, and sometimes, the power supply is configured as a DC-DC power supply.

This Brief Summary has been provided to describe certain concepts in a simplified form that are further described in more detail in the Detailed Description. The Brief Summary does not limit the scope of the claimed subject matter, but rather the words of the claims themselves determine the scope of the claimed subject matter.

BRIEF DESCRIPTION OF THE SEVERAL VIEWS OF THE DRAWINGS

Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. One or more embodiments are described hereinafter with reference to the accompanying drawings in which.

DETAILED DESCRIPTION

The present disclosure may be understood more readily by reference to this detailed description and the accompanying figures. The terminology used herein is for the purpose of describing specific embodiments only and is not limiting to the claims unless a court or accepted body of competent jurisdiction determines that such terminology is limiting. Unless specifically defined in the present disclosure, the terminology used herein is to be given its traditional meaning as known in the relevant art.

In the following description, certain specific details are set forth in order to provide a thorough understanding of various disclosed embodiments. However, one skilled in the relevant art will recognize that embodiments may be practiced without one or more of these specific details, or with other methods, components, materials, etc. Also in these instances, well-known structures may be omitted or shown and described in reduced detail to avoid unnecessarily obscuring more detailed descriptions of the embodiments.

In some cases, a power supply that can provide more than two hundred fifty milliamps (250 mA) is necessary to operate certain DALI-based control gear (i.e., a controlled device). In these cases, despite a DALI specification current limit of 250 mA, it is still desired for the control gear to receive both power and communicate via the DALI bus. Novel circuitry that allows such devices to draw more than 250 mA from an otherwise compliant DALI bus is described in detail herein. The device, method, and system embodiments described in this disclosure (i.e., the teachings of this disclosure) enable the DALI-based control gear (i.e., a controlled device) to draw more than 250 mA during periods of non-communication on the DALI bus via circuitry that electrically couples a high-current power supply to the DALI bus when DALI communications are not detected and electrically de-couples the high-current power supply from the DALI bus when DALI communications are detected.

Figure 1:
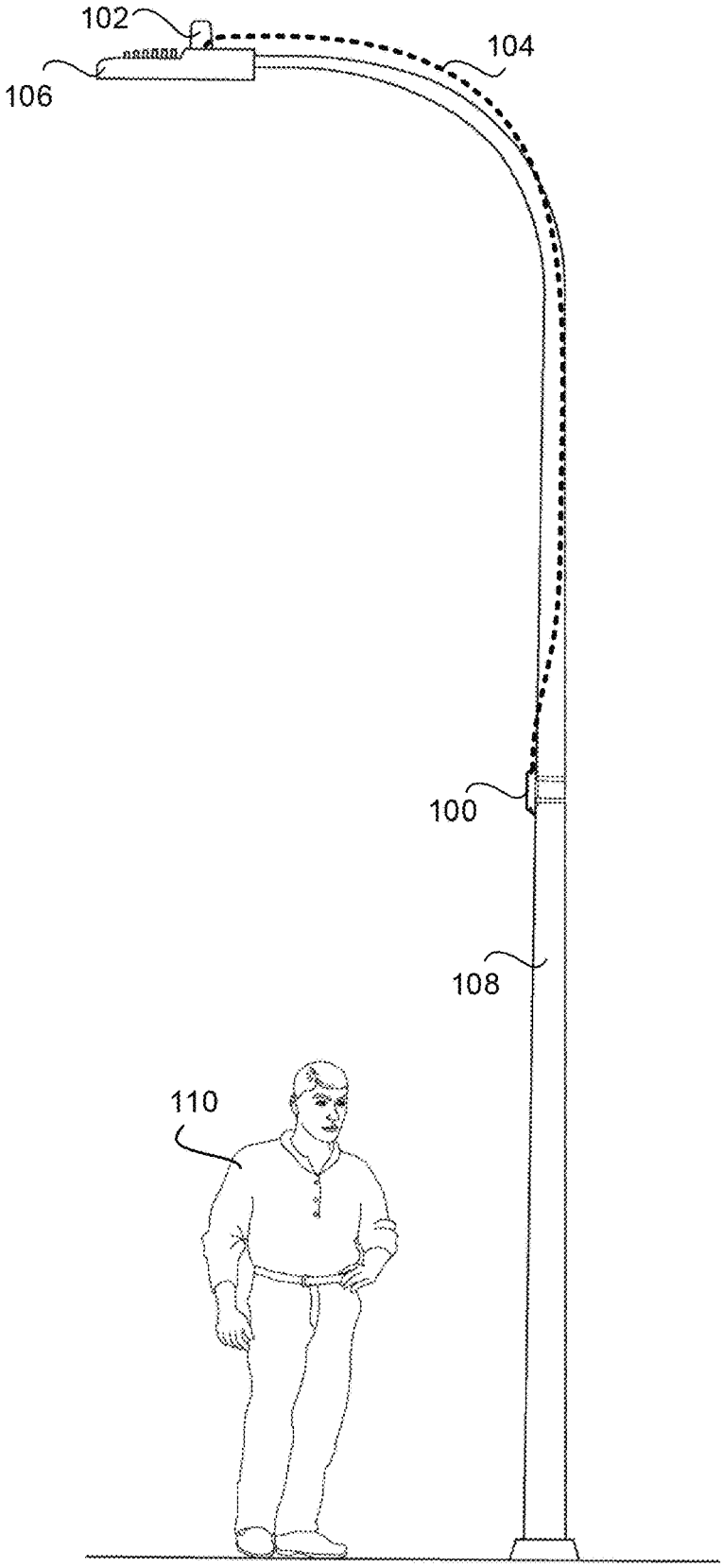
FIG. 1 is an embodiment of a high-power DALI device electrically coupled to a smart sensor device (e.g., a streetlight controller) via a DALI bus.

FIG. 1 is an embodiment of a high-power DALI device 100 electrically coupled to a smart sensor device 102 (e.g., a streetlight controller) via a DALI bus 104. The smart sensor device 102 is electromechanically coupled to a luminaire 106 that is mechanically integrated with and supported by a streetlight pole 108. The luminaire 106 may be powered by mains power. When energized, the luminaire 106 provides light in an area occupied by a user 110.

The high-power DALI device 100 may include any one or more electronic devices arranged to receive power and communicate via a DALI compatible bus. For example, the DALI device 100 may be configured as an air quality sensor, environmental sensor, pollution sensor, carbon monoxide sensor, carbon dioxide sensor, particulate sensor, toxin sensor, smoke detector, fire detector, lightning detector, thermometer, tilt sensor, vibration sensor, pressure sensor, crash detection device, microphone, speaker, horn, light source, light sensor, LED driver, light group controller, light-ballast device, alarm, wind speed measurement device, humidity sensor, flood detector, freezing condition detector, communication device, infrared detection sensor, mobile device transceiver detection, riot sensor, crowd sensor, pedestrian sensor, child sensor, disabled-person sensor, vehicle sensor, wildlife sensor, geophysical sensor of any type, or weather sensor of any type. The previous list of high-power DALI devices is non-limiting and non-exhaustive. Many other high-power DALI control gear devices are also contemplated. Many of the contemplated DALI control gear devices coupled to a DALI-style network bus are arranged to capture data regarding any type of condition to be sensed 114 in proximity of the streetlight luminaire 106, streetlight pole 108, or other location where the smart sensor device 102 is deployed.

In the embodiment of FIG. 1, the high-power DALI device 100 is a controlled DALI device (i.e., control gear) that is coupled to a DALI controller device embodied as a smart sensor device 102. While the present embodiments are illustrated and described in and around streetlights and streetlight controllers, the inventive subject matter described in the present disclosure is not so limited. In fact, the high-power DALI devices described in the present disclosure may be embodied in any controlled device arranged to receive power in communicate via a bus that is entirely or partially compliant with a DALI or DALI-like protocol.

Figure 2:
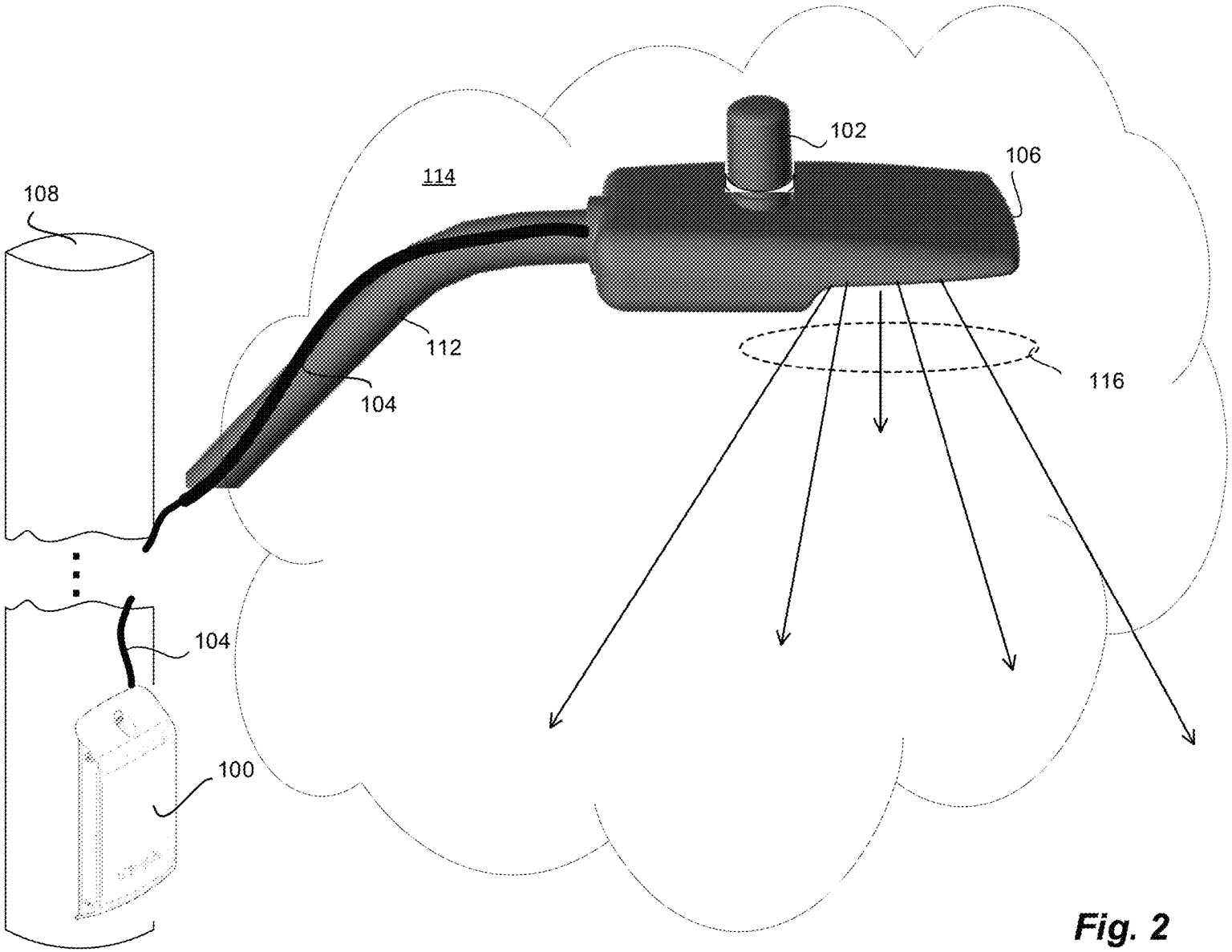
FIG. 2 is the high-power DALI device and smart sensor device of FIG. 1 in more detail.

FIG. 2 is the high-power DALI device 100 and smart sensor device 102 of FIG. 1 in more detail. A portion of the streetlight pole 108 and the luminaire 106 are also shown. A streetlight support structure 112 (e.g., an "arm" or luminaire support) supports the luminaire 106. The luminaire 106 has a top-side connector (e.g., a socket) that is compliant with a roadway area lighting standard promoted by a standards body such as ANSI C136.41 (e.g., a NEMA-based connector/socket system). The smart sensor device 102 includes a corresponding connector (e.g., a set of "pins") at its base, which permits electro-mechanical coupling of the smart sensor device 102 to the luminaire 106.

The smart sensor device 102 in FIG. 2 has support circuitry including a power supply, a controller compatible with a Digital Addressable Lighting Interface (DALI) protocol (i.e., DALI controller), a controller arranged to direct a volume of light 116 output from the luminaire 106 associated with the smart sensor device 102 that is embodied in FIG. 2 as a streetlight control device (e.g., a pulse width modulation (PWM) controller, a light emitting diode (LED) driver, dimming circuit, ballast, and the like), and certain switching and control circuits, which are further described in the present disclosure.

In some cases, the smart sensor device 102 is configured to send, receive, or send and receive information from one or more devices that comply with a DALI protocol (i.e., DALI compliant devices). In this embodiment of FIG. 2, the smart sensor device 102 communicates by passing commands and data through its connector and through the top-side connector of the luminaire 106. Inside the housing of the luminaire 102, a proximal end of a two-wire bus (i.e., the DALI bus 104) is electrically coupled to the top-side connector, and distal end of the two-wire bus is coupled to one or more DALI compliant devices including the high-power DALI device 100. The two-wire bus is implemented as a DALI network bus cable, a jacketed wire having two or more separate and distinct electrical conduits, re-used mains wiring, or in some other configuration that is at least compatible with a standardized DALI protocol or other like protocol.

DALI compliant devices may be control devices (e.g., electronic devices having a DALI controller) or controlled devices (e.g., DALI compatible control gear). A DALI network permits multiple control devices to cooperate on a DALI network bus.

Figure 3B:
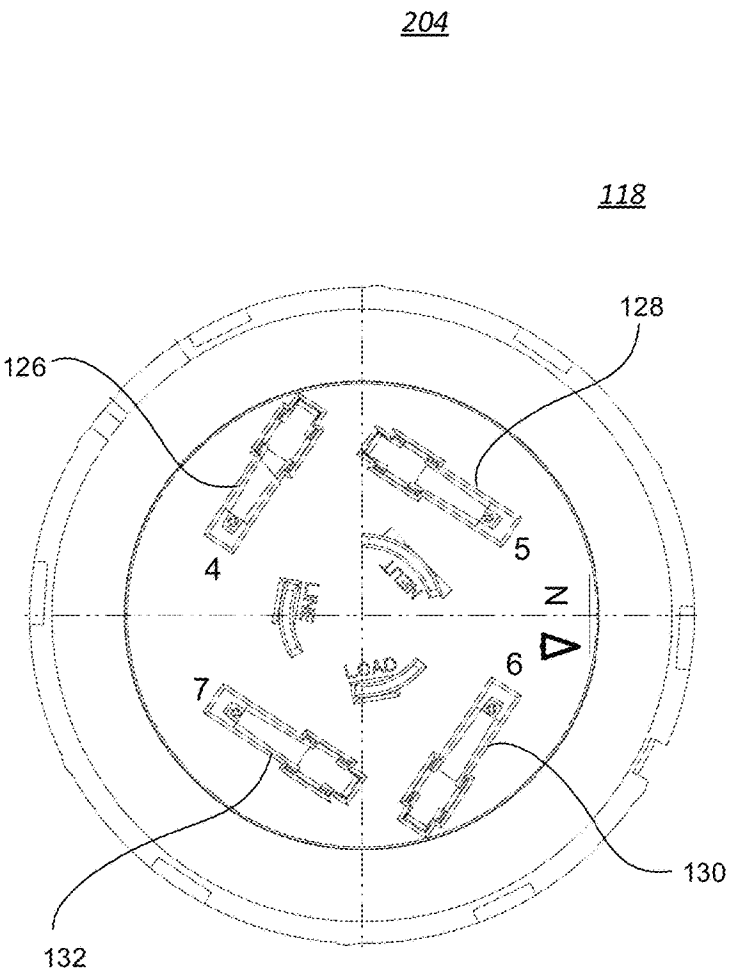
FIG. 3B is an embodiment of a base of the smart sensor device of FIG. 3A.
Figure 3A:
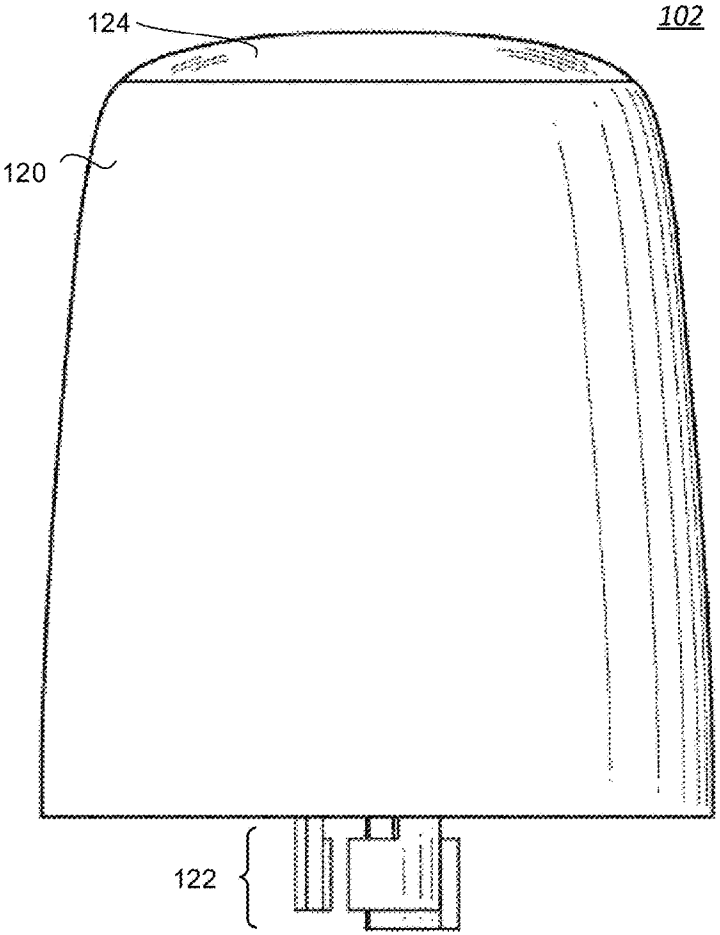
FIG. 3A is a smart sensor device embodiment.

FIG. 3A is a smart sensor device 102 embodiment. FIG. 3B is an embodiment of a base 118 of the smart sensor device 102 of FIG. 3A. The base 118 conforms to a standardized powerline interface. In the present disclosure, FIGS. 3A-3B may be individually or collectively referred to as FIG. 3. Structures earlier identified are not repeated for brevity.

The smart sensor device 102 is arranged with a generally cylindrical housing 120. The generally cylindrical housing 120 may be formed of a plastic, a glass, a metal, a composite material, or any other suitable material. The generally cylindrical housing 120 may in some cases have heat dissipation properties to assist in the removal of heat generated by electronic circuitry inside the housing. In at least some cases, the generally cylindrical housing 120 is arranged to resist the nesting birds or other animals. In at least some cases, the generally cylindrical housing 122-0 is arranged to resist accumulation of dirt, snow, or any foreign bodies or materials. In at least some cases, the generally cylindrical housing 120 is symmetrically arranged to have a generally same visual appearance when viewed from any perspective.

The generally cylindrical housing 120 includes a connector 122 (e.g., a set of "pins") that is compliant with a standardized powerline interface. In the embodiment of FIG. 3, the standardized powerline interface is roadway area lighting standard promoted by a standards body such as ANSI C136.41 (e.g., a NEMA-based connector/socket system), but other standardized powerline interfaces are contemplated (e.g., an interface compliant with the ZHAGA CONSORTIUM, which is an international association that creates industry standards in the LED lighting industry). When the smart sensor device 102 is deployed, the pins of the connector 122 mate with a corresponding receptacle (e.g., a socket) that is integrated in a streetlight, a luminaire, a control box, or some other structure, which permits electro-mechanical coupling of the smart sensor device 102 to the streetlight, luminaire, control box, or the like.

The generally cylindrical housing 120 of the smart sensor device 102 includes a light-transmissive surface 124. The light transmissive surface may be transparent or partially transparent (e.g., partially opaque). In some embodiments, the light-transmissive surface 124 is integrated with the generally cylindrical housing 120, and in other cases, the light-transmissive surface 124 is a distinct structure that is removably or fixedly coupled to the generally cylindrical housing 120. In the embodiment of FIG. 3, the light-transmissive surface 124 is arranged at a "top" of the smart sensor device 102, but in at least some embodiments, the light-transmissive surface 124 is formed additionally or alternatively in or through a surface wall of the generally cylindrical housing 120. Generally, the light-transmissive surface 124 permits ambient light to reach an electronic light sensor (e.g., a photosensor, which is not shown in FIG. 3) formed within a volumetric cavity inside the generally cylindrical housing 120. As described in the present disclosure, the light sensor is arranged, in at least some cases, to provide a first output signal that directs a light source to illuminate when light reaching the light sensor crosses a determined first threshold, and to provide a second signal (e.g., an alteration of the first signal or a different signal) when the light reaching the light sensor crosses a determined second threshold. In some cases, the first and second thresholds are the same thresholds, and in some cases, the first and second thresholds are different thresholds.

Turning to FIG. 3B, a view looking down onto the base 118 of the smart sensor device 102 is presented. Seven contact surfaces are shown in a configuration that complies with a standardized powerline interface. A physical marking, "N" and a corresponding arrow are physically labeled on the base to guide an installer as to the proper orientation of a base 118 when installed.

In the embodiment of FIG. 3, the standardized powerline interface has a set of primary contacts arranged to carry a Line voltage signal, a Load voltage signal, and a Neutral voltage signal, each of which is located about a central location in the base 118 (i.e., semi-circular contact structures (e.g., pins, blades, connectors, or the like) physically labeled "Line," "Load," and "Neut." on the connector represented in FIG. 3B). The primary contacts are arranged to pass a plurality of power transmission signals, which may be high voltage alternating current signals (AC) of 220 VAC, 280 VAC, 480 VAC, or some other voltage.

The standardized powerline interface further has a set of secondary contacts, which includes a first pair of secondary contacts 126, 128 (i.e., two offset spring steel contacts physically labeled "4" and "5," respectively, on the connector represented in FIG. 4B) and a second pair of secondary contacts 130, 132 (i.e., two offset spring steel contacts physically labeled "6" and "7," respectively, on the connector represented in FIG. 3B). In cases where the standardized powerline interface conforms to a NEMA-based protocol such as ANSI C136.41, the first and second pairs of secondary contacts may be referred to as NEMA pins 4/5 and NEMA pins 6/7, respectively. In some cases, the set of four secondary contacts is arranged to carry a plurality of optional dimmer control signals. In cases where the set of four secondary contacts pass dimmer control signals, it is recognized that four dimmer control signals permit two independent dimmer control channels. In some cases, a single dimmer control signal is used as a node for a reference plane (e.g., an earth/chassis ground), and three separate dimmer control signals are implemented or implementable. In other cases, at least some of the four secondary contacts are arranged to communicate encoded binary data, and in still other cases, the secondary contacts implement a particular communication protocol (e.g., USB, I2C, SPI, or the like).

In at least one embodiment, one or more of the four secondary contacts is electrically coupled to a chassis ground (e.g., lamp ground, chassis ground, earth ground). In this way, a physical ground signal that is electrically coupled to a housing of a luminaire includes a stray voltage detection and processing module to detect stray voltage that may be dangerously present on the powerline interface. In at least some cases, a stray voltage is a voltage potential realized between the neutral line Neut. of the standard power transmission signals carried on the standardized powerline interface and the earth/chassis ground of the luminaire. It is recognized that such a potential may be caused by improper grounding, mis-wiring of equipment, equipment failure, failure in insulation around a hot power line conduit, capacitive coupling between energized lines and non-energized lines (e.g., un-connected adjacent wiring), an accident (e.g., a car accident that strikes a power pole and causes an energized powerline too short to the neutral line) or by some other circumstance. This condition, which presents a voltage potential on the chassis of the luminaire, may rise as high as the voltage potential between the line signal or load signal of the powerline interface and the neutral line of the powerline interface. In at least some cases, the powerline interface may be passing signals as high as 480 VAC or higher, and if even a fraction of this voltage signal is present on the chassis of the luminaire or any other structures electrically coupled to the luminaire, then persons, property, and other living things may be at great risk of electric shock, electrocution, or fire.

Figure 4:
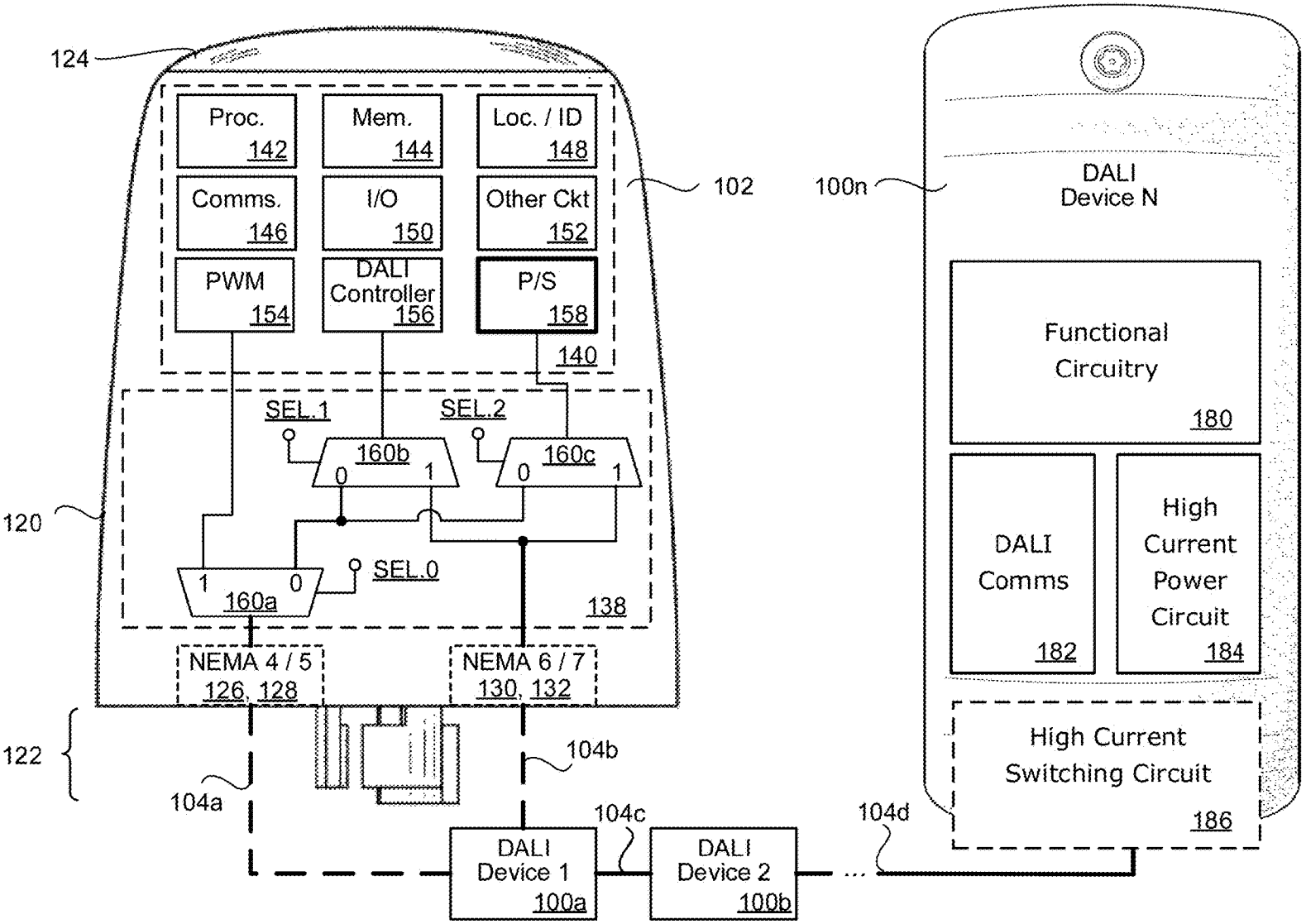
FIG. 4 is a schematic embodiment of the smart sensor device and high-power DALI device.

FIG. 4 is a schematic embodiment of the smart sensor device 102 and high-power DALI device 100*n*. Other DALI-compliant or DALI-like devices 100*a*, 100*b* are also represented. The high-power DALI device 100*n* is a DALI-like device along the lines of the high-power DALI device 100 of FIGS. 1, 2, 4-6 and 8-9. The smart sensor device 102 depicted in FIG. 4 includes a flexible DALI-based control structure. In some embodiments, the smart sensor device 102 of FIG. 4 is optionally also coupled to one or more conventional or high-power DALI, DALI-compliant, or DALI-like devices 100*a*, 100*b* via a DALI or DALI-like network bus 104*a*, 104*b*, 104*c*, 104*d*. One of skill in the art will recognize that the flexible DALI-based control structure of FIG. 4 may be deployed in a smart sensor device 102 or any other such device having a standardized powerline interface (e.g., a small cell networking device, a smart public infrastructure device having cameras, microphones, public-access WiFi circuitry, and the like). The standardized powerline interface of FIG. 4 is a NEMA-based interface compliant with ANSI C136.41, but other standardized powerline interface protocols, connectors, receptacles, and configurations are contemplated.

Limited only by the number of devices supportable in the DALI protocol, any suitable number of smart sensor devices 102 of FIG. 4 may be deployed in a full or partial system level deployment where a plurality of separate and distinct DALI controller devices are deployed. In these cases, a plurality of smart sensor devices 102 may be deployed on one or more streetlights, and each smart sensor device 102 has a flexible system that may include a power supply and a DALI controller along with zero or more DALI control gear devices coupled thereto. The smart devices may be deployed either individually on separate DALI networks or cooperatively on larger DALI networks with many devices.

The smart devices contemplated in the present disclosure are discussed in reference to the smart sensor device 102, and it is understood by those of skill in the art that the teaching of the present disclosure can apply to many types of smart devices including small cells, smart hubs, smart streetlight controllers, smart monitor devices, and many others. The embodiment of FIG. 4 includes DALI configuration circuitry 138 and a microcontroller 140. The smart device 120 also includes a standardized powerline interface, which in the embodiment of FIG. 4 is along the lines of, but not limited to, the NEMA connector of base 118 (FIG. 3). Particularly, the first and second pairs of secondary contacts 126, 128 and 130, 132, respectively and also identified as NEMA pins 4, 5 and NEMA pins 6/7, are called out.

The microcontroller 140 may optionally include a processor 142, memory 144, a communications module 146, a location/identification module 148 (e.g., global positioning system (GPS), MAC ID, IMEI module, or some other unique location or identification structure), an input/output (I/O) module 150, and certain other circuits 152. Additionally, microcontroller may include a pulse width modulation (PWM) circuit 154, a DALI controller 156, and a power supply 158. The microcontroller 140 is represented with a dashed line box to make clear that in some cases, the various circuits and modules are included in a single microcontroller package, and in other cases, any one or more of the modules 142-158 may be partially included in a microcontroller package and partially outside a microcontroller package, or any one or more of the modules 142-158 may be entirely outside of the microcontroller package. Additionally, any one or more of the modules 142-158 may be optionally included or excluded. The particular description herein with respect to the smart sensor device 102 of FIG. 4 does not divert from the teaching of the present disclosure, and any particular representation herein is not limiting unless expressly limited in the claims that follow.

In the embodiment of FIG. 4, the processor 142 is arranged to execute software instructions stored in the memory 144. The execution of such instructions may include retrieving particular data stored in the memory 144, and in at least some cases the cooperation between the executing software instructions and the data stored in the memory causes the I/O module 150 to assert one or more of the selection signals SEL.0, SEL.1, SEL.2 of the DALI configuration circuitry 138. Accordingly, software executing in the microcontroller 140 may in some cases be used to set a particular configuration of use for NEMA pins 4/5 and NEMA pins 6/7 as indicated in Table. 1 herein. What's more, via the teaching of the present disclosure, the DALI configuration circuitry 138 may be flexibly configured in a first configuration at a first time and later re-configured in a second different configuration at a second time, which is later than the first time. In at least some cases, the DALI configuration circuitry 138 may be configured and re-configured any suitable number of times and at any suitable frequency of reconfiguration.

In some cases, further software instructions stored in the memory 144 are arranged to direct output of visual light from a corresponding luminaire, and in this way, the PWM circuit is configured to generate PWM information and pass the same via the first pair of secondary contacts 126, 128 (i.e., NEMA pins 4/5) of the secondary connector to an LED driver in the luminaire. In some cases, software instructions are executed by the processor 142 to cause an interrogation of a selected DALI device, reading data from a selected DALI device, or passing commands to a selected DALI device to direct one or more operations of the selected DALI device. In these or still other cases, the communication module 146 may be arranged to communicate (i.e., transmit, receive, or transmit and receive) information such as DALI information to, from, or to and from a remote computing device via a wireless connection (e.g., a communication medium that conforms to a cellular or cellular-based protocol (e.g., 4G, LTE, 5G, or the like)) facilitated via communications module 146. The communicated information may direct a configuration of the secondary contacts of the standardized powerline interface or some other aspect of the DALI circuitry. Additionally, or alternatively, the communicated information may direct inclusion or exclusion of any DALI-compliant device such as a DALI controller, a DALI control gear (e.g., a sensor), a power supply, or the like.

The DALI configuration circuitry 138 includes a first switching circuit 160*a*, a second switching circuit 160*b*, and a third switching circuit 160*c*. Each of the plurality of switching circuits 160*a*, 160*b*, 160*c* is represented as a multiplexor or selector having a corresponding selection line, SEL.0, SEL.1, and SEL.2, respectively. The configuration table of Table 1, identifies a plurality of configuration state embodiments implementable with the configuration circuitry 138. By applying particular signals on the selection lines SEL.0, SEL.1, and SEL.2 of switching circuits 160*a*, 160*b*, 160*c*, respectively, the first and second pairs of secondary contacts 126, 128 and 130, 132, respectively, can be used to pass selected signals.

TABLE 1

| Switching Circuit Configuration of NEMA pins 4-7 | | | | |
|---|---|---|---|---|
| SEL.0 | SEL.1 | SEL.2 | NEMA 4/5 | NEMA 6/7 |
| 0 | 0 | 0 | DALI + p/s | Other |
| 0 | 0 | 1 | DALI only | DALI + p/s |
| 0 | 1 | 0 | p/s only | DALI only |
| 0 | 1 | 1 | other | DALI + p/s |
| 1 | 0 | 0 | PWM | other |
| 1 | 0 | 1 | PWM | p/s only |
| 1 | 1 | 0 | PWM | DALI only |
| 1 | 1 | 1 | PWM | DALI + p/s |

As further described herein, in some cases, NEMA pins 4/5 are used to pass dimming signals from a pulse width modulation (PWM) dimming circuit 154. This configuration is reached in FIG. 4 when the selection line SEL.0 of first selection circuitry 160*a* is asserted to a binary "1" (e.g., "HI") value. Alternatively, if the selection line SEL.0 of first selection circuitry 160*a* is asserted to a binary "0" (e.g., "LO") value, then NEMA pins 4/5 may be arranged in a non-PWM way. More specifically, if the selection line SEL.0 is asserted LO, then NEMA pins 4/5 may be arranged to carry: 1) DALI controller commands from DALI controller 156 along with power signals from power supply 158 (i.e., when SEL.1 and SEL.2 are both asserted LO); or 2) DALI controller commands from DALI controller 156 only (i.e., when SEL.1 is asserted LO and SEL.2 is asserted HI); or 3) DALI power signals from power supply 158 only (i.e., when SEL.1 is asserted HI and SEL.2 is asserted LO); or 4) some other signal or configuration such as a stray voltage signal (i.e., when SEL.1 and SEL.2 are both asserted HI).

For completeness in the description of Table 1, if NEMA pins 4/5 are configured to carry dimming PWM signals from the PWM circuit 154 (i.e., the selection line SEL.0 of first selection circuitry 160*a* is asserted HI), then NEMA pins 6/7 may be arranged to carry: 1) a non-DALI configuration (i.e., when SEL.1 and SEL.2 are both asserted LO); or 2) DALI controller commands from DALI controller 156 along with power signals from power supply 158 (i.e., when SEL.1 is asserted LO and SEL.2 is asserted HI); or 3) DALI controller commands from DALI controller 156 only (i.e., when SEL.1 is asserted HI and SEL.2 is asserted LO); or 4) power signals from power supply 158 only (i.e., when SEL.1 and SEL.2 are both asserted HI).

When DALI commands are carried out, and additionally or alternatively when a power supply is coupled to a DALI bus 104 (FIG. 1), segments of which are referred to in FIG. 4 a DALI network bus 104*a*, 104*b*, 104*c*, 104*d*, the commands and power signals, as the case may be, are passed via a DALI network bus. As implemented in the embodiment of FIG. 4, one portion of DALI network bus 104*a* is optionally implemented through the first pair of secondary contacts 126, 128 (i.e., NEMA pins 4/5) based on the configuration of the DALI configuration circuitry 138. Correspondingly, another portion of DALI network bus 104*b* is optionally implemented through the second pair of secondary contacts 130, 132 (i.e., NEMA pins 6/7) based on the configuration of the configuration circuitry 138. In this way, power signals and DALI commands may be communicated to any one or more of DALI compliant devices 100*a*, 100*b*, 100*n*. Furthermore, since any number of the smart devices discussed herein may be deployed (e.g., on a plurality of streetlight poles), the plurality of devices may be individually configured to provide power from a single power supply 158 to the DALI network bus 104*a*, 104*b*, 104*c*, 104*d*, while disabling all other power supplies 158 from other smart devices on the DALI network bus 104*a*, 104*b*, 104*c*, 104*d*. And additionally, any number of DALI controllers 156 from any number of smart sensors may be desirably included in the system level embodiment. For the avoidance of doubt, the DALI configuration circuitry 138 of FIG. 4, and the non-limiting configuration of Table 1 are representative of only some of the contemplated configurations. In other cases, for example, where desirable, the DALI configuration circuitry 138 may be arranged such that all of the first and second pairs of contacts of the set of secondary contacts of a standardized powerline interface are left for "other" purposes, and none of such contacts carry PWM signals, DALI command signals, DALI data signals, or power signals.

Notwithstanding the discussion herein, one of skill in the art will recognize that the DALI configuration circuitry 138 may be implemented in a variety of ways without diverting from the teaching of the present disclosure. For example, in some cases, the configuration circuitry 138 may include any one or more of a dedicated microcontroller and associated firmware, relays, diodes, transistors, other semiconductors, state machines, headers, jumper wires, resistors, capacitors, solder pads, the addition or removal of particular circuits or components, and other like means. In at least some cases, one or more configurations represented in Table 1 are implemented on a per-device basis using dedicated static, switchless circuitry.

The DALI devices 100*a*, 100*b*, 100*n* of FIG. 4 may be DALI-compliant devices or DALI-like devices that are capable of communicating via a DALI-compliant protocol. In the present embodiment, one or more of the DALI devices 100*a*, 100*b*, 100*n* operating alone or concurrently in aggregate will draw more than two hundred fifty milliamps (250 mA). In a typical DALI-compliant system, a DALI-compliant power supply is current limited to 250 mA. Hence, in this respect, the embodiment of FIG. 4 is not strictly compliant with a DALI specification.

The high-power DALI device 100*n* includes, among other circuits, functional circuitry functional circuitry 180, a DALI communications interface 182, high-current power circuitry 184, and high-current switching circuitry.

The functional circuitry 180 may be arranged to carry out operations of an air quality sensor, environmental sensor, pollution sensor, carbon monoxide sensor, carbon dioxide sensor, particulate sensor, toxin sensor, smoke detector, fire detector, lightning detector, thermometer, tilt sensor, vibration sensor, pressure sensor, crash detection device, microphone, speaker, horn, light source, light sensor, LED driver, light group controller, light-ballast device, alarm, wind speed measurement device, humidity sensor, flood detector, freezing condition detector, communication device, infrared detection sensor, mobile device transceiver detection, riot sensor, crowd sensor, pedestrian sensor, child sensor, disabled-person sensor, vehicle sensor, wildlife sensor, geophysical sensor of any type, or weather sensor of any type. Along these lines, the functional circuitry 180 may include one or more processors, memory (e.g., volatile memory, non-volatile memory, cache, register space, and the like), input/output (I/O), one or more external communications interfaces (wired communications such as Ethernet and universal serial bus (USB), wireless communications such as cellular and WiFi communications, and the like), one or more user interfaces, and other such logic, which is not shown to avoid unnecessarily obscuring the inventive subject matter in FIG. 4.

The DALI communications interface 182 include circuitry to control the two wires of the DALI-compliant or DALI-like network bus 104*d*. Such control includes the operational ability to detect communication signals on the bus, interpret the information contained in the communication signals on the bus, and code outbound information to be transmitted on the bus.

The high-current power circuitry 184 may include circuitry to convert an incoming direct current (DC) voltage signal from one amplitude to another different amplitude. The high-current power circuitry 184 may include circuitry to distribute power supply signals to various circuits of the functional circuitry 180 and the DALI communications interface 182. Alternatively, or in addition, the high-current power circuitry 184 may include power storage circuits (e.g., a rechargeable battery, a supercapacitor, or the like). In at least some cases, the high-current power circuitry 184 may simply be a node (e.g., one or more traces or pads on a circuit board, one or more terminals, one or more electrical junctions, or the like). Other and additional power circuitry is also contemplated.

The high-current switching circuit 186 is arranged to monitor the DALI-compliant or DALI-like network bus 104*d*. During periods of non-communication network bus 104*d*, the high-current switching circuit 186 will accept a high-current power signal and permit the high-current power signal to charge a power storage medium. Conversely, if the high-current switching circuit 186 detects the start of a DALI communication sequence on the DALI network bus 104*d*, then the high-current switching circuit 186 will electrically decouple the high-current power signal from the power storage medium. In some cases, the high-current power signal will be electrically decoupled for a determined period of time (e.g., at least five (5) seconds, less than thirty (30) seconds, or any other desired time duration); and in some cases the high-current power signal will be electrically decoupled until an end of the DALI communication sequence is detected.

As discussed herein, a DALI-compliant power supply is able to supply a maximum current of 250 mA. In the embodiments of the present disclosure, a high-current power signal is one that exceeds 250 mA. One of skill in the art will recognize that a power signal does not need to persistently exceed 250 mA in order to qualify as a high-current power signal. Instead, a power signal that is a current exceeding 250 mA. Stated differently, the high-current switching circuit 186, and other components of the embodiments discussed herein are capable of providing a power signal having a sustained current that exceeds 250 mA at least some of the time, wherein the time is more than a transient or initial rush current.

Figure 5:
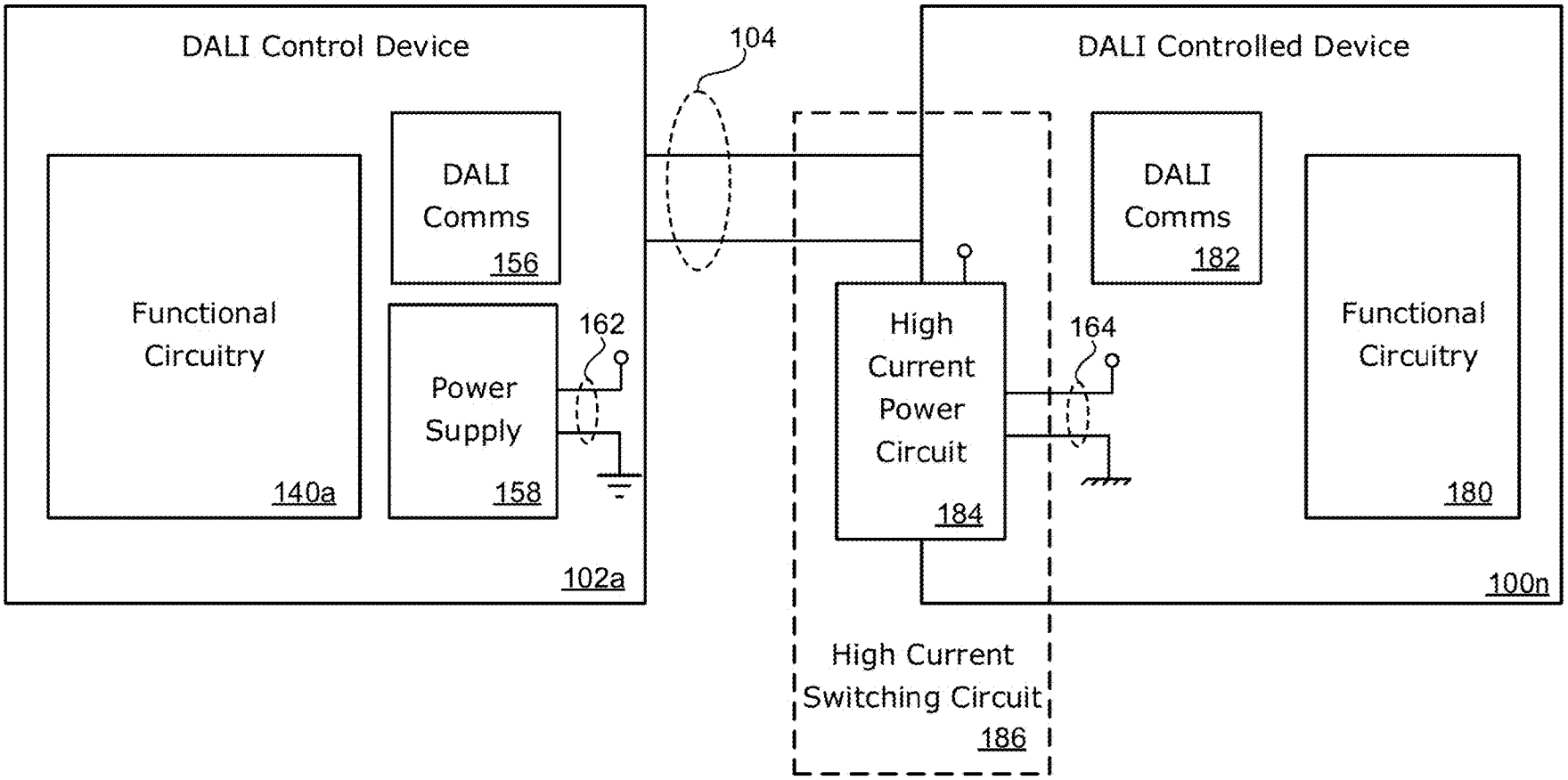
FIG. 5 is a schematic embodiment of a DALI control device electrically coupled to a high-power DALI controlled device.
Figure 6:
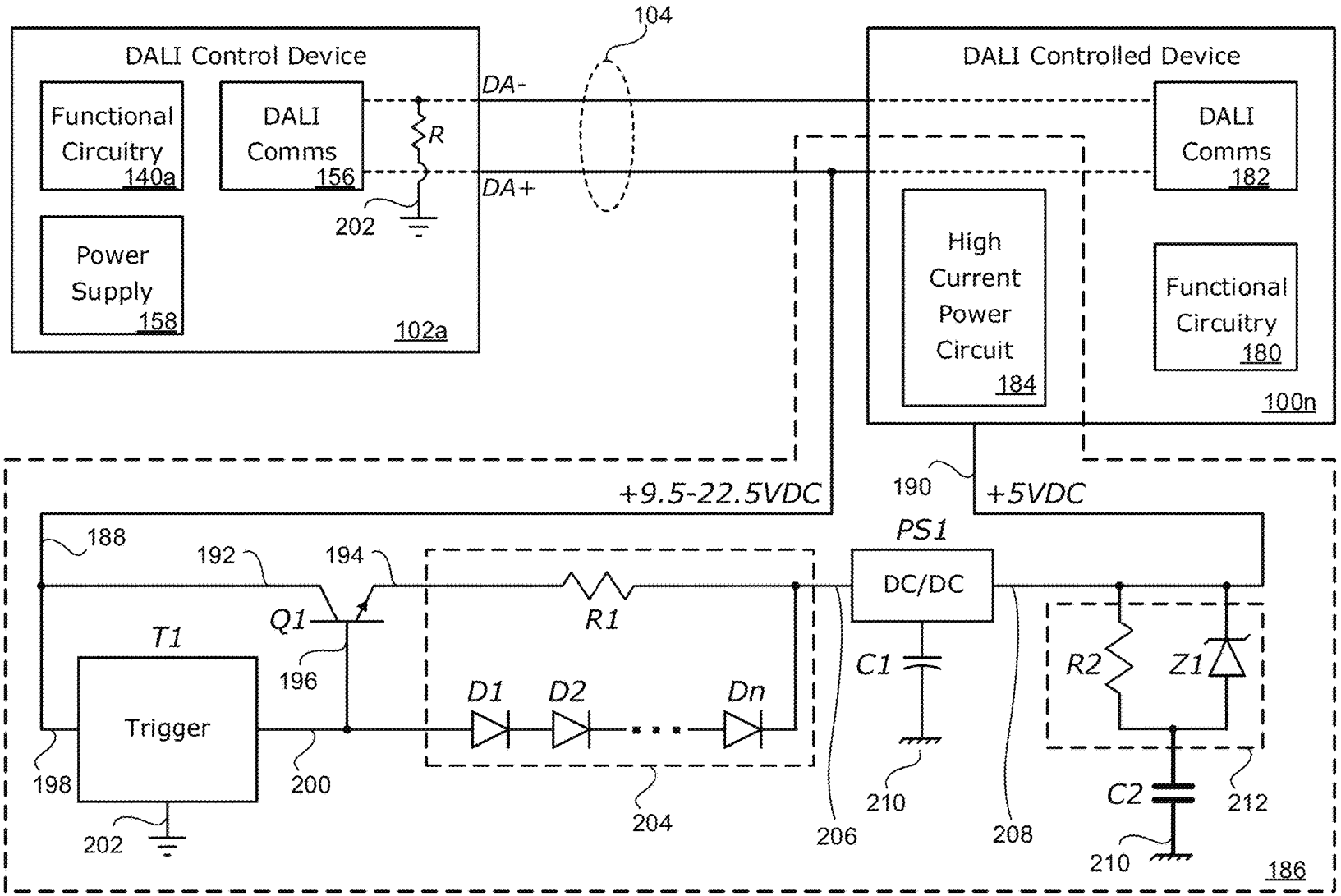
FIG. 6 is the schematic embodiment of FIG. 5 in more detail.

Additional embodiments of high-current switching circuits are illustrated in FIGS. 5 and 6 and described in more detail herein. FIG. 5 is a schematic embodiment of a DALI control device 102*a* electrically coupled to a high-power DALI controlled device 100*n* via a DALI bus 104. FIG. 6 is the schematic embodiment of FIG. 5 in more detail. Structures earlier identified by reference number are not repeated for brevity.

The DALI control device 102*a* of FIG. 5 is along the lines of the smart sensor device 102 of FIGS. 1-4. The DALI control device 102*a* may be a streetlight sensor in some cases, but in other cases, the DALI control device 102*a* is some other type of electronic equipment that includes functional circuitry 140*a*, a DALI communications interface 156, and a power supply 158. The power supply 158 provides power signals 162 (e.g., DALI control device supply and DALi control device ground) to the circuitry of the DALI control device 102*a* and to the DALI bus 104.

The DALI controlled device 100*n* may be any type of electronic equipment that is arranged to receive a high-current power signal. As set forth in the embodiment of FIG. 5, the high-current power circuit 184 and the high-current switching circuit 186 may individually or collectively be fully integrated into a housing of the DALI controlled device 100*n*, partially integrated into a housing of the DALI controlled device 100*n*, or separate and distinct from the housing of the DALI controlled device 100*n*. The high-current switching circuit 186 is electrically coupled to both the DALI bus 104 and other circuits of the DALI controlled device 100*n*, including the high-current power circuit 184. The high-current power circuit 184 is provides power signals 164 (e.g., DALI control device supply and DALi control device ground) to the circuitry of the DALI controlled device 100*n*. The power supply voltage (e.g., which may be referred to as Vdd, $V_{DD}$, V+, or some other like designator) may in some case be entirely or at least partially derived from the DALI bus 104.

FIG. 6 is the schematic embodiment of FIG. 5 in more detail. Particularly, the high-current switching circuit 186 is shown in more detail. In the circuit, a high-current switching circuit input 188 is electrically coupled to the DALI bus 104, and a high-current switching circuit output 190 is electrically coupled to the high-current power circuit 184. The high-current switching circuit input 188 may also be referred to as a voltage/communication signal input, and the high-current switching circuit output 190 may also be referred to as a voltage signal output.

The voltage/communication signal input is electrically received at a switch Q1 and a trigger circuit T1. The switch Q1 is an electronic switch such as a metal oxide semiconductor field effect transistor (MOSFET), a bipolar transistor, or some other type of controllable electronic switch. Within the high-current switching circuit 186, the switch Q1 may also be referred to as a first switch, a control switch, or another like term. The switch Q1 has a first switch input 192, a first switch output 194, and a first switch selector 196.

The trigger circuit T1 has a trigger input 198 and a trigger output 200. The trigger input 198 of the trigger circuit T1 is electrically coupled to the voltage/communication signal input. The trigger output 200 of trigger circuit T1 is electrically coupled to the selector 196 of the first switch Q1.

In accordance with a DALI specification, the voltage signal on the DALI bus 104 may range between nine-and-one-half volts direct current (9.5 VDC) and twenty-two-and-one-half volts direct current (22.5 VDC). Nevertheless, it is also recognized that in some cases of the present embodiments, the voltage on the DALI bus 104 may fall below 9.5 VDC or rise higher than 22.5 VDC.

This voltage signal on the DALI bus 104 is measured between the positive and negative lines of the DALI bus 104, which in some cases may also be referred to as DA+, DA−; DA1, DA2; TX, RX; or with some similar nomenclature. The voltage signal is applied to an input of the high-current switching circuit 186. In this respect, the DALI circuitry of the DALI control device 102*a* and the input circuitry of the high-current switching circuit 186 share a common DALI ground 202.

The trigger circuit T1 is arranged to detect a state change on the voltage/communication signal input. Based on a detected state change, the trigger circuit T1 is further arranged to perform one or more particular acts. For example, in at least some cases, the trigger circuit T1 will assert the switch disabling signal during a communication sequence (i.e., a period of communication) and de-assert the switch disabling signal during periods of non-communication. In other cases, upon detecting a state change, the trigger circuit T1 will institute a timing sequence having a certain time duration and assert a switch disabling signal that causes the first switch selector 196 to disable the switch Q1 during the timing sequence. The certain time duration may be any desirable duration of time. For example in some cases the timing sequence is at least one (1) second. In other cases, the timing sequence is at least twenty (20) seconds. In still other cases, the timing sequence is less than thirty (30) seconds. Many other timing sequence lengths, durations, delays, starting points, ending points, or the like have also been contemplated.

The first switch output 194 and the first switch selector 196 are electrically coupled to a current limiting circuit 204. In particular the first switch output 194 is electrically coupled to a current limiting resistor R1, and the first switch selector 196 is electrically coupled to a set of one or more current limiting switches D1, D2, Dn. The current limiting resistor R1 is sized to determine how much current passes through high-current switching circuit 186. The set of one or more current limiting switches D1, D2, Dn are selected, at least in part, to account for a voltage drop in the first switch Q1. More particularly, at least some switches in the set of one or more current limiting switches D1, D2, Dn are selected to compensate for the voltage drop across the first switch selector 196 and the first switch output 194 (e.g., across the base-emitter junction of Q1, across the gate-drain in a MOSFET, and the like). When the voltage drop across R1 exceeds the forward voltage drop across the remaining switches in the set of the of one or more current limiting switches Q2, Q3, Qn, then current through the set of one or more current limiting switches Q2, Q3, Qn begins to starve the current passing through Q1, which tends to turn off Q1. The result of turning off Q1 is a reduction in current passing through the high-current switching circuit.

Current passing out of the current limiting circuit 204 is received at a power supply input 206 of a power supply PS1. Power supply PS1 in the embodiment of FIG. 6 may be a power conversion circuit arranged, for example, as a switching power supply (i.e., a switch mode power supply, SMPS, or SMP), a linear regulated power supply, or a power conversion circuit of some other type and function. The power supply PS1 may be a buck/boost power supply or some other type of DC-DC converter (e.g., switching power supply). In this case, power supply PS1 receives a power signal at its input that is nominally 9.5 VDC to 22.5 VDC, minus voltage drops across various interim components, and the power supply PS1 produces, at the power supply output 208, a stable, regulated output power signal arranged for use in the DALI controlled device 100*n*. High frequency transient currents caused, for example, by the switching operations of power supply PS1 are shunted by a bypass capacitor C1 to a DALI controlled device ground plane 210. The DALI controlled device ground plane 210 of FIG. 6 is, at least in some cases, electrically coupled to the ground signal of the DALI controlled device power signals 164 in FIG. 5.

The output 208 of the power supply PS1, which may also be referred to as the high-current switching circuit output 190, may be any suitable direct current (DC) voltage signal useful to the DALI controlled device 100*n*. In at least one embodiment, the output power signal of the power supply PS1 is a five volt direct current signal (5 VDC). Output power signals having other characteristics (e.g., voltage, current, stability, persistence, and the like) are also contemplated. For example, in at least some cases, two or more power supplies (not shown) may be cascaded to permit the high-current switching circuit 186 (or high-current power circuit 184) to provide two, three, or any suitable number of different power signals. As another example, two or more different power supply topologies are included in the high-current switching circuit 186 or high-current power circuit 184 (e.g., a first DC-DC converter and a second linear drop-out regulator) to provide power signals having different characteristics. Other topologies, configurations, and numbers of power supplies are also contemplated.

The high-current switching circuit output 190 of FIG. 6 is, at least in some cases, electrically coupled to the voltage source signal of the DALI controlled device power signals 164 in FIG. 5. In such cases, the high-current power circuit 184 may include a direct electrical conduit from the high-current switching circuit 186 to other circuits of the DALI controlled device 100*n*. In these or still other cases, the high-current power circuit 184 further modifies, conditions, filters, or performs other operations on the power signal received at the high-current switching circuit output 190 prior to providing a power signal to other circuits of the DALI controlled device 100*n*.

The power supply output 208 is electrically coupled to a storage element circuit via a charging and regulation circuit 212. The storage element circuit includes at least one storage element C2, and the charging and regulation circuit 212 includes a current limiting resistor R2 and a regulation circuit, which in the embodiment of FIG. 6, includes at least one Zener diode Z1.

When the power supply PS1 is operating, the storage element C2 will receive a charging current that is limited by current limiting resistor R2. In this case, the Zener diode Z1 of the regulation circuit is reversed biased. In the event the DALI controlled device 100*n* applies too great a load on the power supply PS1, the Zener diode will operate in its breakdown region and provide stability to the output voltage signal. Conversely, when the power supply PS1 is not operating, the storage element C2 will provide an output voltage signal to the DALI controlled device 100*n* through a forward biased Zener diode Z1.

The storage element C2 may be any one or more of a supercapacitor, an ultracapacitor, a rechargeable battery, or some other power storage circuit. One or more super capacitors may be electrically connected in series, parallel, or a combination of series and parallel. Generally, a supercapacitor is a capacitor having a capacitance value (i.e., the amount of energy that can be stored per unit volume or mass) much higher (e.g., 10 to 100 times higher) than other types of capacitors and a voltage limit that is much lower (e.g., 10 to 100 times lower) than other types of capacitors. In some respects, a supercapacitor provides the benefits of a rechargeable battery with a longer service life (e.g., the supercapacitor it may tolerate many millions of charge and discharge cycles) than provided by a rechargeable battery. In at least some cases, the storage element C2 has a capacitance rating of between one tenth farad (0.1 F) to ten farads (10 F) or more. In at least one case, the storage element has a capacitance rating of between about one quarter farad (0.25 F) and one farad (1 F).

Considering the operations of the embodiment of FIG. 6, a DALI control device 102*a* is electrically coupled to a DALI controlled device 100*n* via a DALI bus 104. To the DALI circuitry of the DALI control device 102*a*, the high-current switching circuit 186 appears as a load. When there are no active communications on the DALI bus 104, current provided by a power supply 158 of the DALI control device 102*a* (i.e., a voltage/communication signal) passes through the first switch Q1 of the high-current switching circuit 186 and into the power supply PS1 of the high-current switching circuit 186. The power supply PS1 of the high-current switching circuit 186 provides an output voltage signal (e.g., a high-current signal) that is used to power the high-current power circuit 184, functional circuitry 180, and other circuits of the DALI controlled device 100*n*. Subsequently, when the DALI bus 104 is shorted, which indicates the initiation of a communication sequence, the state change is detected by the trigger circuit T1 of the high-current switching circuit 186 and the first switch Q1 is turned off. Turning off the first switch Q1 de-couples the power supply PS1 from the DALI bus 104, which permits the DALI communication sequence to proceed unmolested. During the time that the power supply PS1 is de-coupled, power is provided to the DALI controlled device 100*n* by the storage element C2. In some cases, the power supply PS1 will remain de-coupled for a certain duration of time, and in other cases, the power supply PS1 will remain de-coupled while a communication sequence is detected, and will re-couple to the DALI bus 104 after an end of the communication sequence is detected.

Figure 7A:
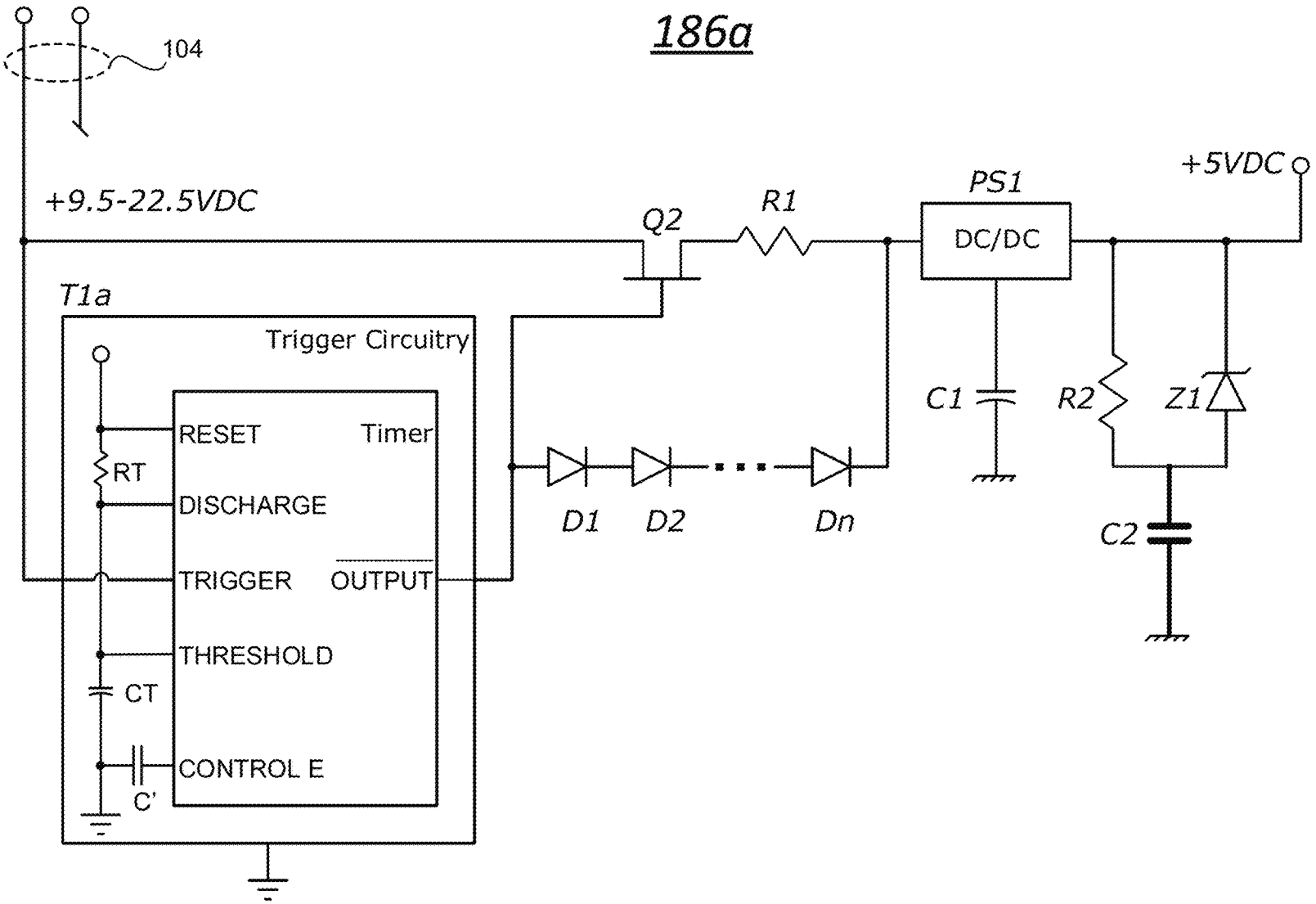
FIG. 7A is an embodiment of a high-current switching circuit showing an embodiment of trigger circuitry in more detail.

FIG. 7A is an embodiment of a high-current switching circuit 186*a* showing an embodiment of trigger circuitry T1*a* in more detail. Trigger circuitry T1*a* may be along the lines of trigger circuitry T1 of FIG. 6. In the embodiment, the trigger circuitry T1*a* includes timer circuitry (e.g., a 555 timer) configured in a monostable mode.

In the timer circuitry, a RESET pin, which is an active-low pin, is coupled to a source voltage to keep the timer circuitry from resetting unexpectedly on a floating or other transient signal. A time-base circuit is coupled between the source voltage and ground. The time-base circuit in the present embodiment is formed by a timing resistor RT and timing capacitor CT arranged in series (i.e., an RC network), however, other time-base circuits are also contemplated. A node between the timing resistor RT and timing capacitor CT is coupled to a DISCHARGE pin and a THRESHOLD pin. The time-base circuit will set a time period that determines how long a particular output of the trigger circuitry T1*a* remains asserted.

The DALI bus 104 input is coupled to a TRIGGER pin of the timer circuitry. During a non-communication period on the DALI bus 104, the timer circuitry will be in its stable state, and the not OUTPUT pin (i.e., OUTPUT, bar OUTPUT, inverted OUTPUT, or the like) of the timer circuitry will be held at a source potential (i.e., a "high" signal, an asserted signal, or the like). The "high" signal will be sensed on the selector line of the first switch Q2. The first switch Q2 in the present embodiment is configured as a MOSFET, but as described in the present disclosure many other switch configurations are contemplated. The application of the "high" signal on the selector line turns on the first switch Q2, which causes the source voltage signal of the DALI bus 104 to be coupled to the power supply PS1 through the current limiting resistor R1 as described herein.

Conversely, when a DALI communication sequence is initiated by shorting the DALI bus 104 to ground, the negative signal applied at the TRIGGER pin of the timer circuitry will cause the not OUTPUT pin of the timer circuitry to drop to a ground potential (i.e., a "low" signal, a de-asserted signal, or the like). The "low" signal will be sensed on the selector line of the first switch Q2, which will disable the first switch Q2 and because the DALI bus 104 to be de-coupled from the power supply PS1. The not OUTPUT pin will be de-asserted when the DALI bus 104 is shorted to ground because the capacitor CT will be at zero volts, and this condition will persist while and whenever the DALI bus 104 is shorted to ground. When the DALI bus 104 returns to source level, the capacitor CT will begin charging through resistor RT. When the voltage of capacitor CT reaches a particular level (e.g., two-thirds of source voltage, three-fourths of source voltage, or some other value), the not OUTPUT pin of the timer circuitry will return to a "high" signal and remain is such stable state until the DALI bus 104 is again shorted to ground.

A CONTROL E (i.e., control voltage) pin, which in some cases is used to provide external reference voltage to internal comparators, is not used in the current configuration. Hence the CONTROL E pin is electrically coupled to ground via a capacitor C' to avoid high frequency noise or other undesirable transient signaling.

Figure 7B:
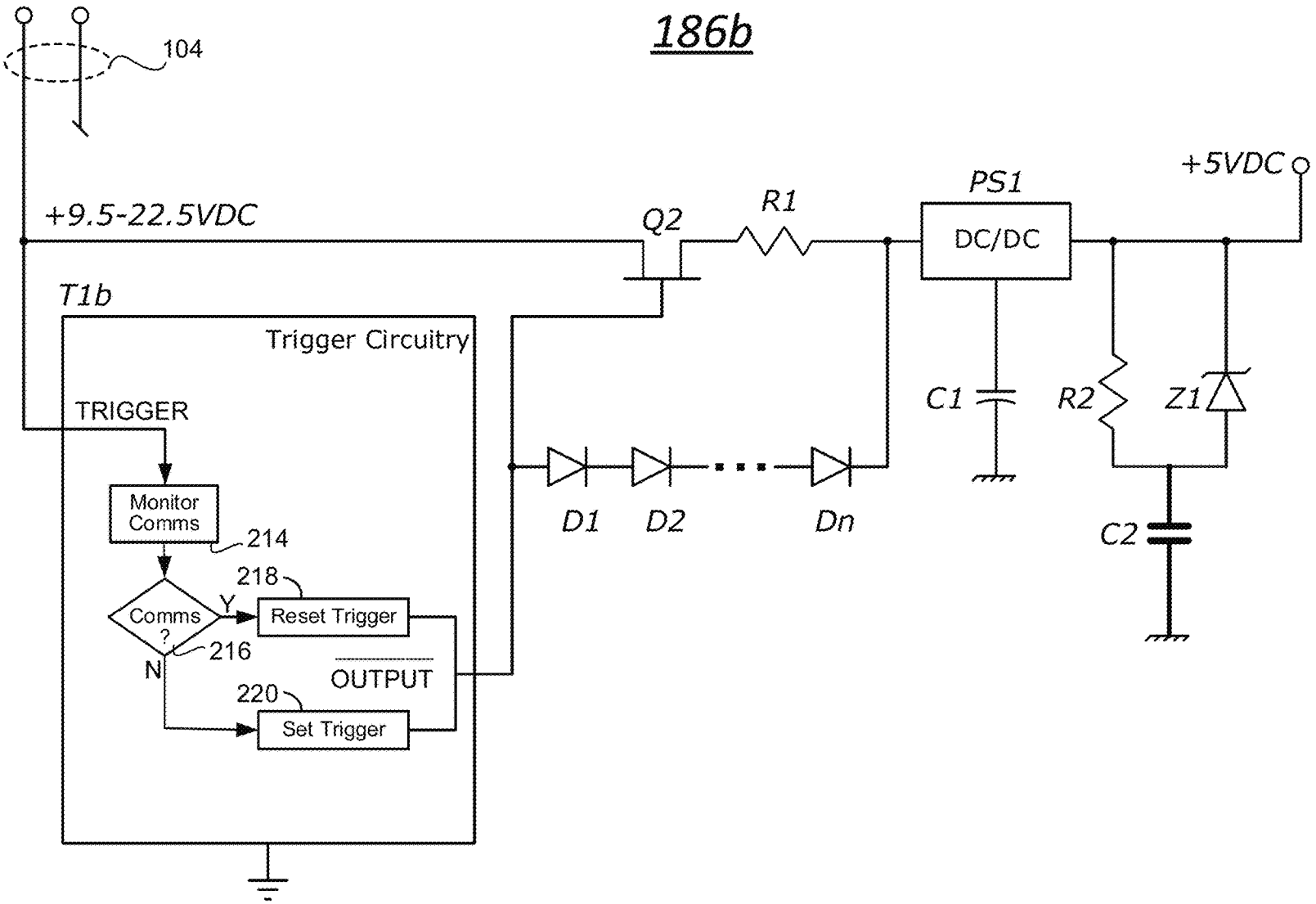
FIG. 7B is an embodiment of a high-current switching circuit showing another embodiment of trigger circuitry in more detail.

FIG. 7B is an embodiment of a high-current switching circuit 186*b* showing another embodiment of trigger circuitry T1*b* in more detail. Trigger circuitry T1*b* may be along the lines of trigger circuitry T1 of FIG. 6. The high-current switching circuit 186*b* is along the lines of the high-current switching circuit 186*a* of FIG. 7A. The trigger circuitry T1*b* of FIG. 7B includes dynamic logic to actively monitor the DALI bus 104 for initiation of a DALI communication sequence. During a period of non-communication on the DALI bus 104, the positive line of the bus (e.g., source voltage signal of a high-current power supply of a DALI control device such as power supply 158 in FIGS. 4 to 6) will be electrically coupled to the power supply PS1 of the high-current switching circuit 186, which is coupled to or otherwise integrated with the DALI controlled device 100*n*. Upon detection of any DALI communication sequence on the DALI bus 104, the positive line of the bus will be de-coupled from the power supply PS1.

In more detail, logic in the trigger circuitry T1*b* monitors communications on the DALI bus 104 at 214. If communications are detected at 216, the trigger is reset at 218, and the not OUTPUT pin provides a "low" signal to the selector of the first switch Q2. If communications are not detected at 216, the trigger is set at 220, and that not OUTPUT pin provides a "high" signal to the selector of the first switch Q2.

Figure 7C:
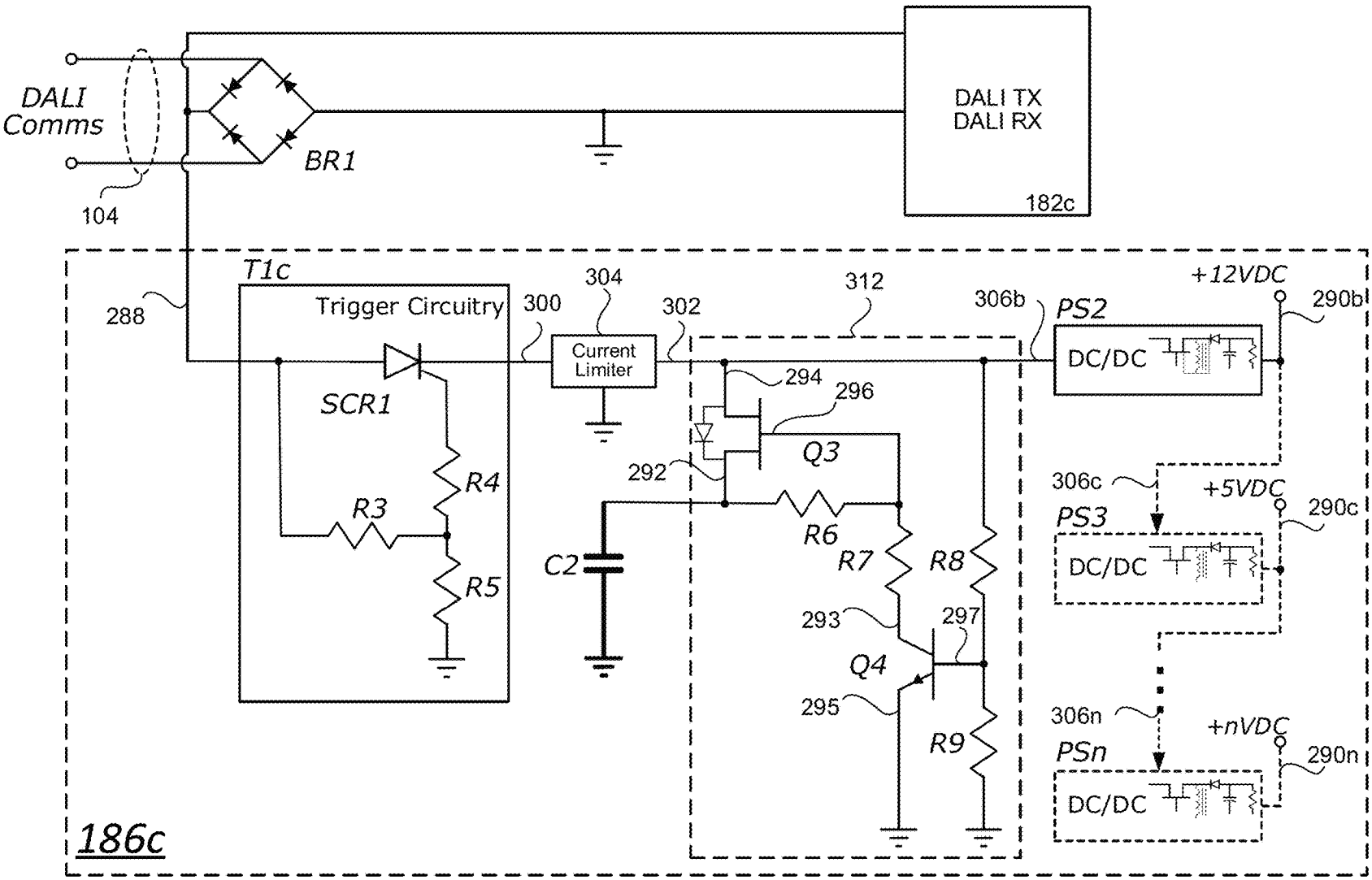
FIG. 7C is yet one more embodiment of a high-current switching circuit showing another embodiment of trigger circuitry in more detail.

FIG. 7C is yet one more embodiment of a high-current switching circuit 186*c* showing another embodiment of trigger circuitry in more detail. Trigger circuitry T1*c* may be along the lines of trigger circuitry T1 of FIG. 6. Particularly, the high-current switching circuit 186*c* embodiment is shown in more detail. In the embodiment, a high-current switching circuit input 288 is electrically coupled to the DALI bus 104. The high-current switching circuit input 288 may be directly coupled to the DALI bus 104 in some cases. Alternatively, in some cases, the high-current switching circuit input 288 is adapted, filtered, adjusted, converted, modified, or otherwise adapted to another suitable form. In the embodiment of FIG. 7C, the DALI bus signals are passed through a bridge rectifier BR1 or other suitable switching circuit. The bridge rectifier BR1 may be a full-wave rectifier or a partial wave rectifier. In at least some cases, the bridge rectifier BR1 facilitates the sharing of a common ground between the circuitry of a DALI control device 102*a* (FIG. 6) and a DALI controlled device 100*n* (FIG. 6). In some cases, the high-current switching circuit input 288 may also be referred to as a signal input, a voltage input, a source input, a voltage/communication signal input, or some other suitable term.

The high-current switching circuit 186*c* is arranged to produce one, two, or any suitable number of high-current switching circuit outputs 290*b*, 290*c*, 290*n*. The one or more high-current switching circuit outputs 290*b*, 290*c*, 290*n* may be coupled to the high-current power circuit 184 of FIG. 6 or any other portion of the controlled DALI device. In some cases, the high-current switching circuit output 290*b*, 290*c*,

290*n* may also be referred to as a signal output, a voltage output, an input device source voltage, a voltage signal output, or some other suitable term.

The high-current switching circuit 186*c* of FIG. 7C optionally includes a plurality of power supplies PS2, PS3, PSn. In some cases, a high-current switching circuit 186*c* may include only a single power supply PS2, which may be along the lines of power supply PS1 (FIGS. 7A, 7B), or which may have a different electrical architecture. Power supply PS2 of FIG. 7C is arranged to produce a twelve volt direct current (12 VDC) output voltage signal at high-current switching circuit output 290*b*. Power supply PS3 of FIG. 7C is arranged to produce a five volt direct current (5 VDC) output voltage signal at high-current switching circuit output 290*c*. Power supply PSn of FIG. 7C is arranged to produce an output alternating current (AC) or direct current (DC) voltage signal of any suitable characteristics at high-current switching circuit output 290*n*.

Any one or more of the power supplies PS2, PS3, PSn in the embodiment of FIG. 7C may be a power conversion circuit arranged, for example, as a switching power supply (i.e., a switch mode power supply, SMPS, or SMP), a linear regulated power supply, or a power conversion circuit of some other type and function. The power supplies PS2, PS3, PSn may be formed as boost power supplies, buck/boost power supplies, or some other type of voltage converters (e.g., switching power supplies). The power supplies may be arranged to step-up an input voltage, step-down an input voltage, step-up an input current, or provide an output signal of any other suitable characteristics. The power supplies may further be arranged with regulation circuitry, filter circuitry, or regulation and filter circuitry. Along these lines, the power supplies may include switches, resistors, capacitors, inductors, fuses, and any other circuits known to one of skill in the power supply arts.

Each power supply PS2, PS3, PSn receives a power signal at its respective input 306*a*, 306*b*, 306*n*. The input power supply signal may nominally be 9.5 VDC to 22.5 VDC, 12 VDC, 5 VDC, or some other voltage. Each power supply PS2, PS3, PSn may produce, at its power supply output 290*b*, 290*c*, 290*n*, respectively, a stable, regulated output power signal arranged for use in the DALI controlled device 100*n* (FIG. 6).

The voltage/communication signal received at the high-current switching circuit input 288 is electrically received at trigger circuit T1*c*. In the embodiment of FIG. 7C, the trigger circuit T1*c* includes a controlled switch SCR1, which may be configured as a silicon-controlled rectifier (SCR) or some other controlled switch. The controlled switch SCR1 in the configuration of FIG. 7C may operate as a bistable switch controlled by a current trigger. The trigger circuit T1*c* also includes one or more resistors R3, R4, R5 arranged in series, parallel, or series and parallel. The resistors may be arranged to form one or more voltage divider networks that control the operating characteristics and parameters of the trigger circuit T1*c*. In some cases, the controlled switch SCR1 is configured by the one or more resistors to trigger at a voltage between about 9.5 VDC and 13.5 VDC. In at least one case, the controlled switch SCR1 is configured to trigger at a voltage of about 11.5 VDC. Other components of the trigger circuit T1*c* known to ones of skill in the art may be included in the trigger circuit T1*c*, but these are not shown to avoid obscuring the features described in the present disclosure.

The controlled switch SCR1 begins conducting when it is forward biased. In other cases, the cathode is held at a low potential voltage relative the anode. When the gate is driven to a high potential, the controlled switch SCR becomes forward biased and permits current from the DALI bus 104 to flow through the trigger circuitry output 300.

In operation, whenever the DALI bus 104 is at a high potential, which may be between 9.5 VDC and 22.5 VDC, the controlled switch SCR1 allows current to pass. Conversely, whenever the DALI bus 104 is at a low potential, which may be below 9.5 VDC or some other suitable value, the controlled switch SCR1 prevents current from passing. In this way, when the DALI bus 104 is idle, the controlled switch SCR1 will be forward biased. In addition, when the DALI bus 104 is in active use and passing "logical one" information, the controlled switch SCR1 will also be forward biased. Alternatively, when the DALI bus 104 is in active use and signaling the start of a communication event by pulling the DALI bus 104 to a low potential, and when the DALI bus 104 is passing "logical zero" information, the controlled switch SCR1 will be reverse biased. Hence, the high-current switching circuitry 186*c* will not affect DALI communications between a DALI control device 102*a* (FIG. 6) and a DALI controlled device 100*n* (FIG. 6) by loading the DALI bus 104 or preventing the DALI bus 104 from being driven to a low potential.

A current limiting circuit 304 is included in the high-current switching circuit 186*c* of FIG. 7C. The current limiting circuit 304 may optionally include one or more switches, resistors, and other electronic components arranged to limit the amount of current passed. In some cases, the current is limited to fifty milliamps (50 mA), seventy milliamps (70 mA), one hundred milliamps (100 mA), one half amp (500 mA), or any other suitable value. The current limiting circuit 236 may be included to maintain operational compliance of the DALI bus 104.

The signal passed through the trigger circuitry T1*c* at the trigger circuitry output 300 is limited by the current limiting circuit 304 and passed out to a current limiting circuit output 302 and on to a charging circuit 312.

The charging circuit 312 is arranged to control the conditions where a storage element C2 is charged and permitted to discharge. The storage element C2 is along the lines of storage element C2 of FIGS. 6, 7A, and 7B.

In the embodiment of FIG. 7C, the charging circuit 312 includes a first electronic switch Q3 arranged such as a metal oxide semiconductor field effect transistor (MOSFET) and a second electronic switch Q4 arranged as a bipolar NPN transistor. Other types of controllable electronic switches are also contemplated. Within the high-current switching circuit 186*c*, the each of the switches Q3, Q4 may also be referred to as a switch, a third switch, a fourth switch, a control switch, or some other like term. In the embodiment of FIG. 7C, the first switch Q3 has a first switch input 292 (e.g., a source), a first switch output 294 (e.g., a drain), and a first switch selector 296 (e.g., a gate). And in the embodiment of FIG. 7C, the second switch Q4 has a second switch input 293 (e.g., collector), a second switch output 295 (e.g., emitter), and a second switch selector 297 (e.g., base).

Various resistors R6, R7, R8, and R9 are represented in the charging circuit 312. The resistors R6, R7, R8, and R9 may suitably be configured in series, in parallel, in series and parallel, or in some other configuration. The resistors R6, R7, R8, and R9 are configured to desirably bias the selectors 296, 297 of the first and second switches Q3, Q4, respectively, during certain conditions associated with operations of the DALI bus 104.

As described herein, the DALI bus 104 will sit at a high potential both when the bus is idle and when the DALI bus 104 is passing a "logical one." Conversely, the DALI bus

104 will be pulled to a low potential when a "logical zero" is being passed. In addition, as described herein, the trigger circuitry T1*c* electrically couples the current limiter circuit 304, the charging circuit 312, the storage element C2, and the optional power supplies PS2, PS3, PSn to the DALI bus 104 when the DALI bus 104 is at a high potential, and the trigger circuitry T1*c* electrically decouples the current limiter circuit 304, the charging circuit 312, the storage element C2, and the optional power supplies PS2, PS3, PSn to the DALI bus 104 when the DALI bus 104 is at a low potential.

In more detail, the charging circuit 312 is arranged to charge the storage element C2 during conditions when a high potential is available on the DALI bus 104. In operation, whenever the DALI bus 104 is at a high potential, which may be between 9.5 VDC and 22.5 VDC, the high potential will be available at the current limiting circuit output 302. If the storage element C2 is not fully charged, then a current will enter the first switch Q3 at the first switch output 294 (e.g., drain), pass through an embedded diode of the first switch Q3, and exit the first switch Q3 at the first switch input 292 (e.g., source). The current is used to dump charge into the storage element C2. In other conditions, the charging circuit 312 is arranged to release charge from the storage element C2 into the optional power supplies PS2, PS3, PSn when the DALI bus 104 is decoupled (i.e., when the DALI bus 104 is at a low potential).

In addition to permissibly charging the storage element C2, the basic idea of the charging circuit 312 is that the first switch selector 296 (e.g., the gate of the P-channel MOSFET first switch Q3) is controlled by the presence or absence of a current passing through the second switch Q4 (e.g., the base of the NPN transistor second switch selector 297 to the emitter of the NPN transistor second switch output 295). In more detail, the second switch Q4 is turned on by the voltage divider of R8/R9. If a voltage of sufficiently high potential is received at the input of the charging circuit 312 (i.e., current limiting circuit output 302), then a voltage of sufficiently high potential is received at the second switch selector 297, and the second switch Q4 is turned on. Alternatively, if a voltage of sufficiently high potential is not received at the second switch selector 297, then the second switch Q4 is turned off.

When the second switch Q4 is turned on, a closed circuit is formed from the second switch input 293, through the second switch Q4, to the second switch output 295. If the storage element C2 has sufficient charge, then a voltage is applied to the first switch selector 296, and the first switch Q3 is turned off. In this way, the voltage on the DALI bus 104 is used to drive the optional power supplies PS2, PS3, PSn while the storage element C2 remains charged.

Alternatively, when the second switch Q4 is turned off, an open circuit is formed between the second switch input 293 and the second switch output 295, and this causes the first switch Q3 to turn on. If the storage element C2 has sufficient charge, then a current path from the first switch input 292 to the first switch output 294 through the first switch Q3 is formed. In this way, the voltage at the storage element C2 is used to drive the optional power supplies PS2, PS3, PSn.

Complementary to the operations described, if the charge in the storage element C2 falls sufficiently low, then the first switch Q3 is turned off, and the storage element is prevented from a deep discharge.

Figure 8:
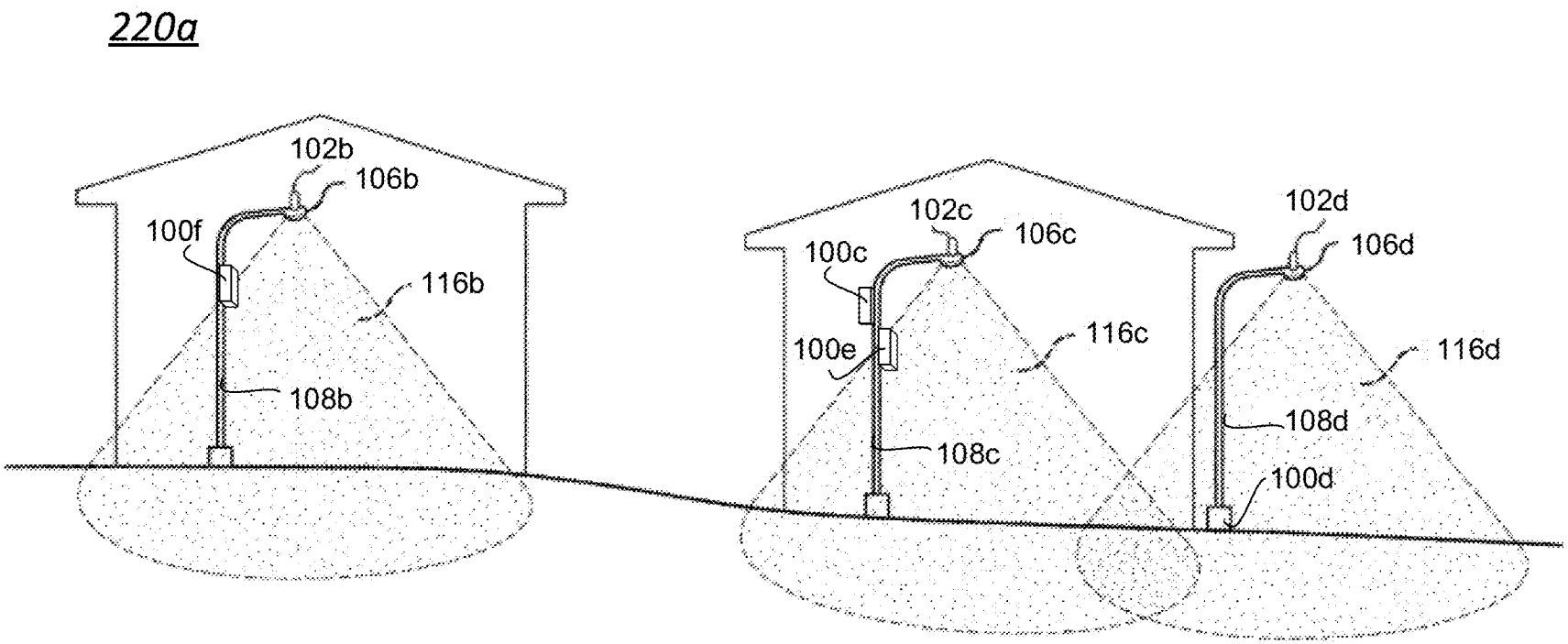
FIG. 8 is a systemwide deployment of certain embodiments of high-power DALI devices.

FIG. 8 is a systemwide deployment 220*a* of certain embodiments of high-power DALI devices. In the system level deployment 220*a*, three streetlight poles 106*b*, 106*c*, 106*d* and corresponding fixtures 106*b*, 106*c*, 106*d*, each with a smart sensor device 102*b*, 102*c*, 102*d* (e.g., three DALI control devices) are shown. In some cases, a light sensor detects both ambient light from above its respective fixture and other light from different directions. For example, where light from two light sources 116*c*, 116*d* overlap, one or more of the smart sensor devices 102*b*, 102*c*, 102*d* may adjust their light output. The adjustment may be a reduction in light output, a directional change to light output, or some other adjustment. Along these lines, where light from two light sources 116*b*, 116*c* do not overlap at all, there may be areas in need of additional illumination. In this case, one or more of the smart sensor devices 102*b*, 102*c*, 102*d* may adjust their light output.

In some cases, the smart sensor devices 102*b*, 102*c*, 102*d* are arranged with DALI compliant devices. In FIG. 8, various smart sensor devices 102*b*, 102*c*, 102*d* are coupled to one or more respective DALI controlled devices 100*c*, 100*d*, 100*e*, 100*f* via respective DALI network bus cables. To avoid unnecessarily obfuscating FIG. 8, the DALI network bus cables are not shown. In the system level deployment 220*a*, a first DALI compliant device 100*f* may be arranged to dynamically detect motion (e.g., infrared detection sensor, mobile device transceiver detection, riot sensor, crowd sensor, pedestrian sensor, child sensor, disabled-person sensor, vehicle sensor, wildlife sensor, or the like), and a DALI controller in the smart sensor device 102*b* may be arranged to adjust light output to increase, decrease, or change other parameters such as a direction of light output when the motion is directionally detected or detected based on some other parameter. A second DALI compliant device 100*c* may be an air quality sensor, and a third DALI compliant device 100*e* may be a weather or other environmental condition sensor (e.g., wind sensor, humidity sensor, temperature sensor, vibration sensor, pressure sensor, or any one or more of the like). Yet one more DALI compliant device 100*d* may be a water level sensor, freezing condition sensor, or the like. May other DALI compliant device types, deployment locations, and deployment conditions are contemplated.

In some cases, each of the separate and distinct streetlight poles 108*b*, 108*c*, 108*d* in the system level deployment 220*a* of FIG. 8 operates its own closed DALI network. In other cases, some or all of the separate and distinct streetlight poles 108*b*, 108*c*, 108*d* in the system level deployment 220*a* implement a common DALI network with one or more DALI control devices and a plurality of DALI controlled (i.e., DALI control gear) devices. A DALI network may be configured as a daisy chain, a star topology, or a combination of daisy chain and star topologies. Additionally, a DALI network may operate with one, two, or more DALI control devices. One limitation of a DALI network, however, is that a DALI-compliant power supply is limited to outputting 250 mA. Accordingly, the inventors have recognized that in cases along the lines of the system level deployment 220*a* where a plurality of separate and distinct streetlight poles are deployed, it would be technically beneficial to design and build a flexible high-current power supply system that can cooperate in an otherwise DALI-compliant system of DALI power supplies, DALI controllers, and DALI controlled gear that can be deployed either individually on separate DALI networks or cooperatively on larger DALI networks with many devices having higher current needs than a 250 mA maximum current DALI-compliant power supply can provide.

Figure 9:
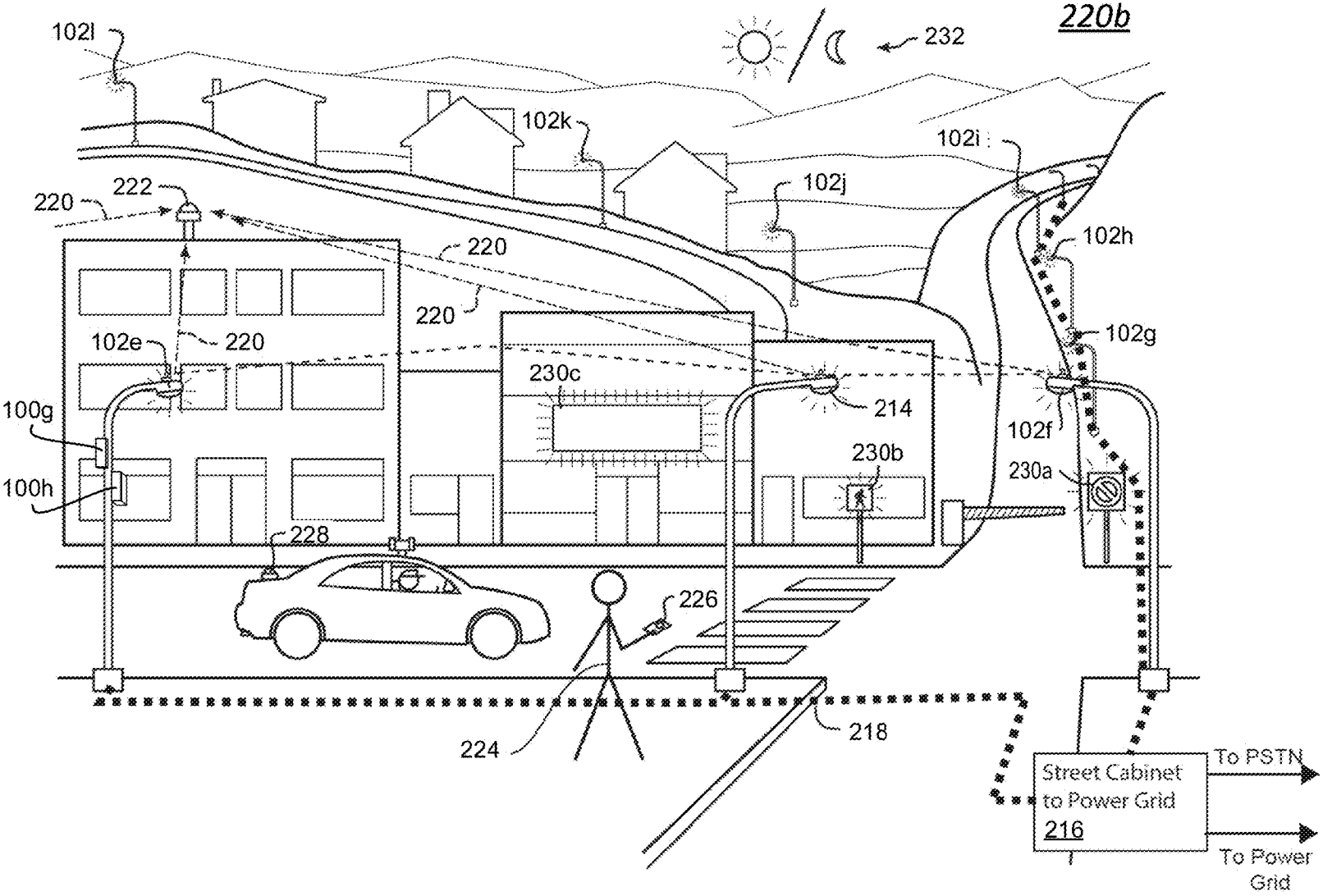
FIG. 9 is another systemwide deployment of certain embodiments of high-power DALI devices.

FIG. 9 is another systemwide deployment 220*b* of certain embodiments of high-power DALI devices. In the system level deployment 220*b*, several smart sensor devices are coupled to streetlight fixtures. The smart sensor devices are in many, but not all, cases implemented as smart streetlight controllers, small cells, smart camera devices, public WiFi devices, or the like. The smart sensor devices include inventive control mechanisms for lighting-based control networks.

Streetlight fixtures in FIG. 9 are coupled to or otherwise arranged as part of a system of streetlight poles, and each streetlight fixture includes a light source. Each light source, light fixture, and light fitting, individually or along with their related components, may in some cases be interchangeably referred to as a luminaire, a light source, a streetlight, a streetlamp, or some other such suitable term. In the system level deployment 220*b*, at least one light pole includes a fixture with a small cell networking device 214, and a plurality of light poles each have a smart sensor device 102*e*-1021. In the present disclosure, light poles having a smart sensor device 102*e*-1021 may individually or collectively be referred to as light poles having a smart sensor device 102 or simply light poles 102 for brevity. In these cases, and for the purposes of the present disclosure, the light sensor of each light pole 102 may be structurally and operatively identical (i.e., having same or substantially similar circuitry and embedded software, and differing by way of one or more network-level system identifiers).

In any desirable case, a smart sensor device 102*e*-1021 or small cell device 214 may be communicatively, electrically, or communicatively and electrically coupled to one or more DALI-compliant or DALI-like control gear (i.e., controlled devices) of the type described in the present disclosure. In FIG. 9, a smart sensor device 102*e* is coupled to two DALI controlled devices 100*g*, 100*h*, via one or more respective DALI network bus cables. To avoid unnecessarily obfuscating FIG. 9, the DALI network bus cables are not shown, and no other smart devices are shown coupled to DALI-compliant or DALI-like control gear. Nevertheless, one of skill in the art will recognize that any suitable number of DALI-compliant or DALI-like control gear devices may be cooperatively coupled to any respective, suitable smart devices.

As shown in the system level deployment 220*b*, a plurality of light poles 102, 214 are arranged in one or more determined geographic areas, and each light pole 102, 214 has at least one light source positioned in a fixture. The fixture is at least twenty feet above ground level and in at least some cases, the fixtures are between about 20 feet and 40 feet above ground level. In other cases, the streetlight fixtures may of course be lower than 20 feet above the ground or higher than 40 feet above the ground. In other system level deployments according to the present disclosure, there may be 1,000 or more light poles 102, 214 arranged in one or more determined geographic areas. In these or in still other cases, the streetlight fixtures may of course be lower than 20 feet above the ground or higher than 40 feet above the ground. Although described as being above the ground, streetlight fixtures shown and contemplated in the present disclosure may also be subterranean, but positioned above the floor, such as in a tunnel.

The system of streetlight poles, streetlight fixtures, streetlight sources, or the like in the system level deployment may be controlled by a municipality or other government agency. In other cases, the system streetlight poles, streetlight fixtures, streetlight sources, or the like in the system level deployment is controlled by a private entity (e.g., private property owner, third-party service contractor, or the like). In still other cases, a plurality of entities share control of the system of streetlight poles, streetlight fixtures, streetlight sources, or the like. The shared control may be hierarchical or cooperative in some other fashion. For example, when the system is controlled by a municipality or a department of transportation, an emergency services agency (e.g., law enforcement, medical services, fire services) may be able to request or otherwise take control of the system. In still other cases, one or more sub-parts of the system of streetlight poles, streetlight fixtures, streetlight sources, or the like can be granted some control such as in a neighborhood, around a hospital or fire department, in a construction area, or in some other manner.

In the system level deployment 220*b* of FIG. 9, any number of streetlight poles 102, 214 and their associated fixtures may be arranged with a connector that is compliant with a roadway area lighting standard promoted by a standards body such as ANSI C136.41 (e.g., a NEMA-based connector/socket system). The connector permits the controlling or servicing authority of the system to competitively and efficiently purchase and install light sensors on each streetlight fixture. In addition, or in the alternative, the standardized connector in each streetlight fixture permits the controlling or servicing authority to replace conventional light sensors with other devices such as a small cell networking device, a smart sensor device (FIGS. 1-6, 8), or some other device.

In the system level deployment 220*b*, a small cell networking device 214 is electromechanically coupled to a selected light pole wherein the electromechanical coupling is performed via the connector that is compliant with the roadway area lighting standard promoted by a standards body. Stated differently, the system level deployment 220*b* includes at least one light pole and fixture with a small cell networking device 214, and a plurality of light poles each having a smart sensor device 102*e*-1021. In these light poles, each streetlight fixture is equipped with a standalone smart device such as the smart sensor device of FIGS. 1-6 and 8 that is electromechanically coupled via a respective connector that is compliant with the roadway area lighting standard promoted by the standards body. In this arrangement, each streetlight 102, 214 is equipped with a light sensor that is further electrically coupled to a processor-based light control circuit. In at least some of these embodiments, electrically coupling the light sensor to the processor-based light control circuit includes passing a signal representing an amount of light detected by the light sensor to the processor-based light control circuit. In at least some of these embodiments, the light sensor is arranged to detect an amount of lux, lumens, or other measurement of luminous flux and generate the signal representing the amount of light detected.

The processor-based light control circuit of each smart device is arranged to provide a light control signal to the respective light source based on at least one ambient light signal generated by a light sensor associated with the processor-based light control circuit. In addition, because each streetlight 102, 214 is equipped with communication capabilities, each light source in each streetlight 102, 214 can be controlled remotely as an independent light source or in combination with other light sources. In at least some of these cases, each of the plurality of light poles and fixtures with a smart sensor device 102 is communicatively coupled to the light pole and fixture with a small cell networking device 214. The communicative relationship from each of the plurality of light poles and fixtures with a smart sensor device 102 to the light pole and fixture with a small cell networking device 214 may be a direct communication or an indirect communication. That is, in some cases, one of the plurality of light poles and fixtures with a smart sensor device 102 may communicate directly to the light pole and fixture with a small cell networking device 214 or the one of the plurality of light poles and fixtures with a smart sensor device 102 may communicate via one or more other ones of the plurality of light poles and fixtures with a smart sensor device 214 or via some other means (e.g., via a cellular communication to a traditional cellular macro-cell, via a wired connection, or the like).

In the system level deployment 220*b* of FIG. 9, various ones of the light poles may be 50 feet apart, 100 feet apart, 250 feet apart, or some other distance. In some cases, the type and performance characteristics of each small cell networking device and each smart sensor device are selected based on their respective distance to other such devices such that wireless communications are acceptable.

The light pole and fixture with a small cell networking device 214 and each light pole and fixture with a smart sensor device 102 may be directly or indirectly coupled to a street cabinet 216 or other like structure that provides utility power (e.g., "the power grid") in a wired way. The utility power may provide 120 VAC, 208 VAC, 220 VAC, 240 VAC, 260 VAC, 277 VAC, 360 VAC, 415 VAC, 480 VAC, 600 VAC, or some other power source voltage. In addition, the light pole and fixture with a small cell networking device 214, and optionally one or more of the light poles and fixtures with smart sensor devices 102*e*-1021, are also coupled to the same street cabinet 216 or another structure via a wired backhaul connection. It is understood that these wired connections are in some cases separate wired connections (e.g., copper wire, fiber optic cable, industrial Ethernet cable, or the like) and in some cases combined wired connections (e.g., power over Ethernet (PoE), powerline communications (PLC), or the like). For simplification of the system level deployment 220*b* of FIG. 9, the wired backhaul and power line 218 is illustrated as a single line. In the embodiment of FIG. 9, the street cabinet 216 is coupled to the power grid, which is administered by a licensed power utility agency, and the street cabinet 216 is coupled to the public switched telephone network (PSTN). In other embodiments, the street cabinet 216 may be electrically, communicatively, or electrically and communicatively to some other infrastructure (e.g., power source, satellite communication network, or the like) such as a windmill, generator, solar source, fuel cell, satellite dish, long- or short-wave transceiver, or the like.

In some embodiments, any number of small cell networking devices 214 and smart sensor devices 102 are arranged to provide utility grade power metering functions. The utility grade power metering functions may be performed with a circuit arranged to apply any one or more of a full load, a partial load, and a load where voltage and current are out of phase (e.g., 60 degrees; 0.5 power factor). Other metering methodologies are also contemplated.

In some but not every case, each light pole and fixture with a smart sensor device 102 is in direct or indirect wireless communication with the light pole and fixture that has the small cell networking device 214. In addition, each light pole and fixture with a smart sensor device 102 and the light pole and fixture with the small cell networking device 214 may also be in direct or indirect wireless communication 220 with an optional remote computing device 222. The remote computing device 222, when it is included in the system level deployment 220*b*, may be controlled by a mobile network operator (MNO), a municipality, another government agency, a third party, or some other entity. By this optional arrangement, the remote computing device 222 can be arranged to wirelessly communicate light control signals and any other information (e.g., packetized data) between itself and each respective wireless networking device coupled to any of the plurality of light poles.

A user 224 holding a mobile device 226 is represented in the system level deployment 220*b* of FIG. 9. A vehicle having an in-vehicle mobile device 228 is also represented. The vehicle may be an emergency service vehicle, a passenger vehicle, a commercial vehicle, a public transportation vehicle, a drone, or some other type of vehicle. The user 224 may use their mobile device 226 to establish a wireless communication session over a cellular-based network controlled by an MNO, wherein packetized wireless data is passed through the light pole and fixture with a small cell networking device 214. Concurrently, the in-vehicle mobile device 228 may also establish a wireless communication session over the same or a different cellular-based network controlled by the same or a different MNO, wherein packetized wireless data of the second session is also passed through the light pole and fixture with a small cell networking device 214.

Other devices may also communicate through light pole-based devices of the system level deployment 220*b*. These devices may be internet of things (IoT) devices or some other types of devices. In FIG. 9, two public information signs 230A, 230B, and a private entity sign 230C are shown, but many other types of devices are contemplated. Each one of these devices may form an unlicensed wireless communication session (e.g., WiFi) or a cellular-based wireless communication session with one or more wireless networks made available by the devices shown in the system level deployment 220*b* of FIG. 9.

The sun and moon 232 are shown in FIG. 9. Light or the absence of light based on time of day, weather, geography, programmatic tracking of one or more heavenly bodies (i.e., planets, moons, stars, or the like) or other causes provide information (e.g., ambient light, position of the heavenly body or bodies of interest) to the light sensors or other logic of the light pole mounted devices described in the present disclosure. Based on this information, the associated light sources may be suitably controlled.

Having now set forth certain embodiments, further clarification of certain terms used herein may be helpful to providing a more complete understanding of that which is considered inventive in the present disclosure.

Mobile network operators (MNOs) provide wireless cellular-based services in accordance with one or more cellular-based technologies. As used in the present disclosure, "cellular-based" should be interpreted in a broad sense to include any of the variety of technologies that implement wireless or mobile communications. Exemplary cellular-based systems include, but are not limited to, time division multiple access ("TDMA") systems, code division multiple access ("CDMA") systems, and Global System for Mobile communications ("GSM") systems. Some others of these technologies are conventionally referred to as UMTS, WCDMA, 4G, 5G, and LTE. Still other cellular-based technologies are also known now or will be known in the future. The underlying cellular-based technologies are mentioned here for a clearer understanding of the present disclosure, but the inventive aspects discussed herein are not limited to any particular cellular-based technology.

In some cases, cellular-based voice traffic is treated as digital data. In such cases, the term "voice-over-Internet-Protocol", or "VoIP," may be used to mean any type of voice service that is provided over a data network, such as an Internet Protocol (IP) based network. The term VoIP is interpreted broadly to include any system wherein a voice signal from a mobile computing device is represented as a digital signal that travels over a data network. VoIP then may also include any system wherein a digital signal from a data network is delivered to a mobile computing device where it is later delivered as an audio signal.

Standardized powerline interface connector devices of the types described herein are in at least some cases referred to as NEMA devices, NEMA compatible devices, NEMA compliant devices, or the like. And these devices include receptacles, connectors, sockets, holders, components, etc. Hence, as used in the present disclosure and elsewhere, those of skill in the art will recognize that coupling the term "NEMA" or the term "ANSI" with any such device indicates a device or structure compliant with a standard promoted by a standards body such as NEMA, ANSI, IEEE, or the like.

A mobile device, or mobile computing device, as the terms are used interchangeably herein, is an electronic device provisioned by at least one mobile network operator (MNO) to communicate data through the MNO's cellular-based network. The data may be voice data, short message service (SMS) data, electronic mail, world-wide web or other information conventionally referred to as "internet traffic," or any other type of electromagnetically communicable information. The data may be digital data or analog data. The data may be packetized or non-packetized. The data may be formed or passed at a particular priority level, or the data may have no assigned priority level at all. A non-comprehensive, non-limiting list of mobile devices is provided to aid in understanding the bounds of the term, "mobile device," as used herein. Mobile devices (i.e., mobile computing devices) include cell phones, smart phones, flip phone, tablets, phablets, handheld computers, laptop computers, body-worn computers, and the like. Certain other electronic equipment in any form factor may also be referred to as a mobile device when this equipment is provisioned for cellular-based communication on an MNO's cellular-based network. Examples of this other electronic equipment include in-vehicle devices, medical devices, industrial equipment, retail sales equipment, wholesale sales equipment, utility monitoring equipment, and other such equipment used by private, public, government, and other entities.

Mobile devices further have a collection of input/output ports for passing data over short distances to and from the mobile device. For example, serial ports, USB ports, WiFi ports, Bluetooth ports, IEEE 1394 FireWire, and the like can communicatively couple the mobile device to other computing apparatuses.

Mobile devices have a battery or other power source, and they may or may not have a display. In many mobile devices, a signal strength indicator is prominently positioned on the display to provide network communication connectivity information to the mobile device user.

A cellular transceiver is used to couple the mobile device to other communication devices through the cellular-based communication network. In some cases, software and data in a file system are communicated between the mobile device and a computing server via the cellular transceiver. That is, bidirectional communication between a mobile device and a computing server is facilitated by the cellular transceiver. For example, a computing server may download a new or updated version of software to the mobile device over the cellular-based communication network. As another example, the mobile device may communicate any other data to the computing server over the cellular-based communication network.

Each mobile device client has electronic memory accessible by at least one processing unit within the device. The memory is programmed with software that directs the one or more processing units. Some of the software modules in the memory control the operation of the mobile device with respect to generation, collection, and distribution or other use of data. In some cases, software directs the collection of individual datums, and in other cases, software directs the collection of sets of data.

Software may include a fully executable software program, a simple configuration data file, a link to additional directions, or any combination of known software types. When the computing server updates software, the update may be small or large. For example, in some cases, a computing server downloads a small configuration data file to as part of software, and in other cases, computing server completely replaces all of the present software on the mobile device with a fresh version. In some cases, software, data, or software and data is encrypted, encoded, and/or otherwise compressed for reasons that include security, privacy, data transfer speed, data cost, or the like.

Processing devices, or "processors," as described herein, include central processing units (CPU's), microprocessors, microcontrollers (MCU), digital signal processors (DSP), application specific integrated circuits (ASIC), state machines, and the like. Accordingly, a processor as described herein includes any device, system, or part thereof that controls at least one operation, and such a device may be implemented in hardware, firmware, or software, or some combination of at least two of the same. The functionality associated with any particular processor may be centralized or distributed, whether locally or remotely. A processor may interchangeably refer to any type of electronic control circuitry configured to execute programmed software instructions. The programmed instructions may be high-level software instructions, compiled software instructions, assembly-language software instructions, object code, binary code, micro-code, or the like. The programmed instructions may reside in internal or external memory or may be hard-coded as a state machine or set of control signals. According to methods and devices referenced herein, one or more embodiments describe software executable by the processor, which when executed, carries out one or more of the method acts.

As known by one skilled in the art, a computing device, including but not limited to a mobile computing device, smart sensor device, small cell device, and other such devices, has one or more memories, and each memory may comprise any combination of volatile and non-volatile computer-readable media for reading and writing. Volatile computer-readable media includes, for example, random access memory (RAM). Non-volatile computer-readable media includes, for example, any one or more of read only memory (ROM), magnetic media such as a hard-disk, an optical disk, a flash memory device, a CD-ROM, and the like. In some cases, a particular memory is separated virtually or physically into separate areas, such as a first memory, a second memory, a third memory, etc. In these cases, it is understood that the different divisions of memory may be in different devices or embodied in a single memory. Some or all of the stored contents of a memory may include software instructions executable by a processing device to carry out one or more particular acts.

In the present disclosure, memory may be used in one configuration or another. The memory may be configured to store data. In the alternative or in addition, the memory may be a non-transitory computer readable medium (CRM) wherein the CRM is configured to store instructions executable by a processor. The instructions may be stored individually or as groups of instructions in files. The files may include functions, services, libraries, and the like. The files may include one or more computer programs or may be part of a larger computer program. Alternatively, or in addition, each file may include data or other computational support material useful to carry out the computing functions of the systems, methods, and apparatus described in the present disclosure.

As used in the present disclosure, the term "module" refers to an application specific integrated circuit (ASIC), an electronic circuit, a processor and a memory operative to execute one or more software or firmware programs, combinational logic circuitry, or other suitable components (hardware, software, or hardware and software) that provide the functionality described with respect to the module.

The terms, "real-time" or "real time," as used herein and in the claims that follow, are not intended to imply instantaneous processing, transmission, reception, or otherwise as the case may be. Instead, the terms, "real-time" and "real time" imply that the activity occurs over an acceptably short period of time (e.g., over a period of microseconds or milliseconds), and that the activity may be performed on an ongoing basis (e.g., recording and reporting the collection of utility grade power metering data, recording and reporting IoT data, crowd control data, anomalous action data, and the like). An example of an activity that is not real-time is one that occurs over an extended period of time (e.g., hours or days)] or that occurs based on intervention or direction by a person or other activity.

In the absence of any specific clarification related to its express use in a particular context, where the terms "substantial" or "about" in any grammatical form are used as modifiers in the present disclosure and any appended claims (e.g., to modify a structure, a dimension, a measurement, or some other characteristic), it is understood that the characteristic may vary by up to 30 percent. For example, a small cell networking device may be described as being mounted "substantially horizontal," In these cases, a device that is mounted exactly horizontal is mounted along an "X" axis and a "Y" axis that is normal (i.e., 90 degrees or at right angle) to a plane or line formed by a "Z" axis. Different from the exact precision of the term, "horizontal," and the use of "substantially" or "about" to modify the characteristic permits a variance of the particular characteristic by up to 30 percent. As another example, a small cell networking device having a particular linear dimension of between about six (6) inches and twelve (12) inches includes such devices in which the linear dimension varies by up to 30 percent. Accordingly, the particular linear dimension of the small cell networking device may be between 2.4 inches and 15.6 inches.

The terms "include" and "comprise" as well as derivatives thereof, in all of their syntactic contexts, are to be construed without limitation in an open, inclusive sense, (e.g., "including, but not limited to"). The term "or," is inclusive, meaning and/or. The phrases "associated with" and "associated therewith," as well as derivatives thereof, can be understood as meaning to include, be included within, interconnect with, contain, be contained within, connect to or with, couple to or with, be communicable with, cooperate with, interleave, juxtapose, be proximate to, be bound to or with, have, have a property of, or the like.

Unless the context requires otherwise, throughout the specification and claims which follow, the word "comprise" and variations thereof, such as, "comprises" and "comprising," are to be construed in an open, inclusive sense, e.g., "including, but not limited to."

Reference throughout this specification to "one embodiment" or "an embodiment" and variations thereof means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content and context clearly dictates otherwise. It should also be noted that the conjunctive terms, "and" and "or" are generally employed in the broadest sense to include "and/or" unless the content and context clearly dictates inclusivity or exclusivity as the case may be. In addition, the composition of "and" and "or" when recited herein as "and/or" is intended to encompass an embodiment that includes all of the associated items or ideas and one or more other alternative embodiments that include fewer than all of the associated items or ideas.

In the present disclosure, conjunctive lists make use of a comma, which may be known as an Oxford comma, a Harvard comma, a serial comma, or another like term. Such lists are intended to connect words, clauses or sentences such that the thing following the comma is also included in the list.

As described herein, for simplicity, a user is in some case described in the context of the male gender. For example, the terms "his," "him," and the like may be used. It is understood that a user can be of any gender, and the terms "he," "his," and the like as used herein are to be interpreted broadly inclusive of all known gender definitions.

As the context may require in this disclosure, except as the context may dictate otherwise, the singular shall mean the plural and vice versa; all pronouns shall mean and include the person, entity, firm or corporation to which they relate; and the masculine shall mean the feminine and vice versa.

When so arranged as described herein, each computing device may be transformed from a generic and unspecific computing device to a combination device comprising hardware and software configured for a specific and particular purpose. When so arranged as described herein, to the extent that any of the inventive concepts described herein are found by a body of competent adjudication to be subsumed in an abstract idea, the ordered combination of elements and limitations are expressly presented to provide a requisite inventive concept by transforming the abstract idea into a tangible and concrete practical application of that abstract idea.

The use of the phrase "set" (e.g., "a set of items") or "subset," unless otherwise noted or contradicted by context, is to be construed as a nonempty collection comprising one or more members.

The headings and Abstract of the Disclosure provided herein are for convenience only and do not limit or interpret the scope or meaning of the embodiments.

The various embodiments described above can be combined to provide further embodiments. Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

Various devices that utilize the circuits and modules of the present disclosure are described in U.S. Patent Application No. 62/614,918, filed Jan. 8, 2018, which is incorporated herein by reference in its entirety to the fullest extent allowed by law.

Various devices that utilize the circuits and modules of the present disclosure are described in International Patent Application PCT/US2019/012775, filed Jan. 8, 2019, which is incorporated by reference in its entirety to the fullest extent allowed by law.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A circuit, comprising:
- a voltage/communication signal input;
- a voltage signal output;
- a switch having a switch input, a switch output, and a switch selector, the switch input electrically coupled to the voltage/communication signal input;
- a timer circuit having a timer input and a timer output, the timer input electrically coupled to the voltage/communication signal input and the timer output electrically coupled to the switch selector, wherein the timer circuit is arranged to:
  - detect a state change on the voltage/communication signal input; and
  - based on the detected state change, the timer circuit further arranged to:
    - institute a timing sequence having a certain time duration; and
    - assert a switch disabling signal that causes the switch selector to disable the switch during the timing sequence;
- a power supply having a power supply input and a power supply output, the power supply output electrically coupled to the voltage signal output;
- a current limiting circuit electrically coupled between the switch output and the power supply input; and
- a storage element circuit electrically coupled to the power supply output and the voltage signal output, the storage element configured to receive a charging voltage from the power supply at a first time, and further configured to provide a supply voltage to the voltage signal output during a second time.

2. The circuit of claim 1, wherein the timing sequence is at least one (1) second.

3. The circuit of claim 1, wherein the timing sequence is at least twenty (20) seconds.

4. The circuit of claim 1, wherein the timing sequence is less than thirty (30) seconds.

5. The circuit of claim 1, wherein the voltage/communication signal input is configured as a digital addressable lighting interface (DALI) signal input.

6. The circuit of claim 1, wherein the power supply is configured as a DC-DC power supply.

7. The circuit of claim 6, wherein the DC/DC power supply is configured as a buck/boost power supply.

8. The circuit of claim 1, wherein the current limiting circuit includes a plurality of electronic switch circuits.

9. The circuit of claim 1, wherein the storage element circuit includes at least one super-capacitor.

10. The circuit of claim 1, wherein the circuit is integrated with a streetlight mounted sensor.

11. A method to power a digital addressable lighting interface (DALI) slave device, comprising:
- receiving a voltage/communication signal at an input of a high-current switching circuit of a streetlight powered controller;
- sourcing a power supply with the voltage/communication signal;
- generating a direct current (DC) voltage signal with the power supply;
- charging a storage element with the DC voltage signal;
- sourcing the DALI slave device with power derived from the voltage/communication signal;
- detecting initiation of a communication sequence on the voltage/communication signal input; and
- based on the detected initiation of the communication sequence, electrically decoupling the power derived from the voltage/communication signal from the DALI slave device, and electrically sourcing the DALI slave device with power derived from the storage element.

12. The method of claim 11, further comprising:
- detecting an end of the communication sequence on the voltage/communication signal input; and
- based on the detected end of the communication sequence, electrically decoupling the power derived from the storage element and electrically sourcing the DALI slave device with power derived from the voltage/communication signal.

13. The method of claim 11, further comprising:
- based on the detected initiation of the communication sequence, triggering a timer circuit to initiate a timing sequence having a certain time duration;
- during the time duration:
  - electrically decoupling the power derived from the voltage/communication signal from the DALI slave device; and
  - electrically sourcing the DALI slave device with power derived from the storage element; and
- after expiration of the time duration:
  - electrically decoupling the power derived from the storage element; and
  - electrically sourcing the DALI slave device with power derived from the voltage/communication signal.

14. The method of claim 11, wherein the certain time duration is less than thirty (30) seconds.

15. The method of claim 11, wherein the certain time duration is at least five (5) seconds.

16. The method of claim 11, wherein the direct current (DC) voltage signal generated with the power supply is a signal that exceeds two hundred fifty milliamps (250 mA).

17. The method of claim 11, wherein the direct current (DC) voltage signal generated with the power supply is a signal that exceeds five hundred milliamps (500 mA).

18. A system, comprising:
- a digital addressable lighting interface (DALI) bus arranged to pass a voltage/communication signal;
- a smart lighting device having a DALI controller arranged to source at least part of the voltage/communication signal;

a controlled device electrically coupled to the smart lighting device via the DALI bus, wherein the controlled device is arranged to receive a first high-current signal during a non-communication period on the DALI bus, and wherein the controlled device is arranged to receive a second high-current signal during a communication period on the DALI bus and a high-current power circuit having:

a voltage/communication signal input that is electrically coupled to a DALI bus;

a voltage signal output that is electrically coupled to the controlled device;

a DC-DC power supply arranged to source the first high-current signal, wherein the DC-DC power supply is at least sometimes electrically coupled to the voltage signal output;

a storage element arranged to source the second high-current signal, wherein the storage element is at least sometimes electrically coupled to the voltage signal output; and a switching circuit electrically coupled to the voltage/communication signal input and arranged to:

electrically decouple the DC-DC power supply from the controlled device during the communication period; and electrically decouple the storage element from the controlled device during the non-communication period.

19. The system of claim 18, wherein the high-current power circuit further includes:

a detection circuit electrically coupled to the voltage/communication signal input, the detection circuit arranged to detect initiation of the communication period.

20. The system of claim 18, wherein the high-current power circuit further includes:

a timer circuit arranged to initiate a timing sequence that defines a duration of the communication period.

* * * * *